US011519180B2

(12) United States Patent
Bilge

(10) Patent No.: US 11,519,180 B2
(45) Date of Patent: Dec. 6, 2022

(54) SYSTEM FOR MOUNTING WALL PANELS ONTO A WALL OR FLOOR SLABS

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 68 days.

(21) Appl. No.: 17/199,386

(22) Filed: Mar. 11, 2021

(65) Prior Publication Data

US 2022/0290442 A1 Sep. 15, 2022

(51) Int. Cl.
*E04F 13/08* (2006.01)

(52) U.S. Cl.
CPC ..... *E04F 13/0816* (2013.01); *E04F 13/0807* (2013.01)

(58) Field of Classification Search
CPC . E04F 13/0816; E04F 13/083; E04F 13/0807; E04F 13/07; E04F 13/081
See application file for complete search history.

(56) References Cited

U.S. PATENT DOCUMENTS 6,226,947 B1 * 5/2001 Bado ..... E04F 13/0816 52/479
8,127,507 B1 * 3/2012 Bilge ..... E04F 13/0814 52/235
8,468,765 B1 * 6/2013 Kim ..... E04F 13/14 52/510
8,966,849 B1 * 3/2015 Bilge ..... E04F 13/22 52/506.05
8,979,052 B2 * 3/2015 Uota ..... E04F 13/0801 403/381
9,151,052 B2 * 10/2015 Krause ..... E04F 13/0803
9,200,455 B2 * 12/2015 Preston ..... E04F 13/06
9,359,770 B1 * 6/2016 Bilge ..... E04F 13/0812
9,506,252 B2 * 11/2016 Molteni ..... E04B 1/40
9,562,361 B2 * 2/2017 Bilge ..... E04F 13/0891
9,631,372 B1 * 4/2017 Bilge ..... E04F 13/072
9,765,528 B2 * 9/2017 Bilge ..... E04F 13/0891
9,896,849 B1 * 2/2018 Aboukhalil ..... E04F 13/0803
10,011,997 B1 * 7/2018 Bilge ..... E04F 13/0801
10,253,505 B2 * 4/2019 Bilge ..... E04F 13/083
10,253,507 B1 * 4/2019 Bilge ..... E04F 13/0807
10,260,240 B1 * 4/2019 Bilge ..... E04F 13/0807
10,900,239 B1 * 1/2021 Bilge ..... E04F 13/083
D954,532 S * 6/2022 Bilge ..... D25/124
2006/0260261 A1 * 11/2006 Cervenko ..... E04F 13/0807 52/712
2008/0134594 A1 * 6/2008 Ness ..... E04F 13/081 52/200
2008/0155917 A1 * 7/2008 Bilge ..... E04F 13/0814 52/235
2009/0241451 A1 * 10/2009 Griffiths ..... E04F 13/0889 52/309.4

(Continued)

*Primary Examiner* — Gisele D Ford
(74) *Attorney, Agent, or Firm* — Joshua Kaplan, Esq; Kaplan Law Practice LLC

(57) ABSTRACT

The disclosed invention provides a system and method of installing wall panels unto an existing wall. The primary object of the disclosed system is to enable mounting of wall panels or windows on an erected latticework. Such latticework is deployed on exteriors of existing walls or is mounted across floor slabs. The system is comprised of a plurality of parallel upright assemblies stretching from slab of one floor to slab of the next floor. Crossmembers fastened to the parallel upright assemblies serve as mounting points for wall or window paneling.

19 Claims, 22 Drawing Sheets

(56) References Cited

U.S. PATENT DOCUMENTS

| | | | | |
|---|---|---|---|---|
| 2010/0251647 | A1* | 10/2010 | Enns | E04F 13/081 52/302.1 |
| 2010/0263314 | A1* | 10/2010 | MacDonald | E04F 13/12 52/506.05 |
| 2012/0017530 | A1* | 1/2012 | Hummel, III | E04F 13/081 52/506.05 |
| 2012/0304572 | A1* | 12/2012 | Aboukhalil | E04F 13/0816 52/489.1 |
| 2013/0205698 | A1* | 8/2013 | Todd | E04F 13/072 52/302.1 |
| 2013/0269276 | A1* | 10/2013 | Gaynor | E04F 13/083 52/506.05 |
| 2014/0290166 | A1* | 10/2014 | Bordener | E04F 13/0816 52/474 |
| 2015/0128518 | A1* | 5/2015 | Knight | E04F 13/0864 52/404.1 |
| 2015/0308098 | A1* | 10/2015 | Tessadori | E04B 2/7411 52/698 |
| 2015/0345152 | A1* | 12/2015 | Libreiro | E04F 13/12 52/800.1 |
| 2016/0102462 | A1* | 4/2016 | Griffiths | E04F 13/0862 52/550 |
| 2016/0289977 | A1* | 10/2016 | Lucchese | E04F 13/0819 |
| 2016/0319552 | A1* | 11/2016 | Aboukhalil | E04F 13/0807 |
| 2019/0153727 | A1* | 5/2019 | Stahl, Jr. | E04B 2/825 |
| 2019/0169855 | A1* | 6/2019 | Czyz | E04F 13/0819 |
| 2019/0309514 | A1* | 10/2019 | Stahl, Jr. | E04B 2/965 |
| 2021/0404180 | A1* | 12/2021 | Krause | E04B 2/74 |

* cited by examiner

Fig. 1 Replacement Figure

Fig. 2 Replacement Figure

Fig. 3 Replacement Figure 46
48
48
50
28
28
12
44
48
48
48

302
306
40
42
44
46
48
50
52
54
56
58
60
62
64
66
68
70
72
74
76
78
80
82
84
86
88
90
92
94
96
98
100
102
104
106
108
110
112
114
116
118

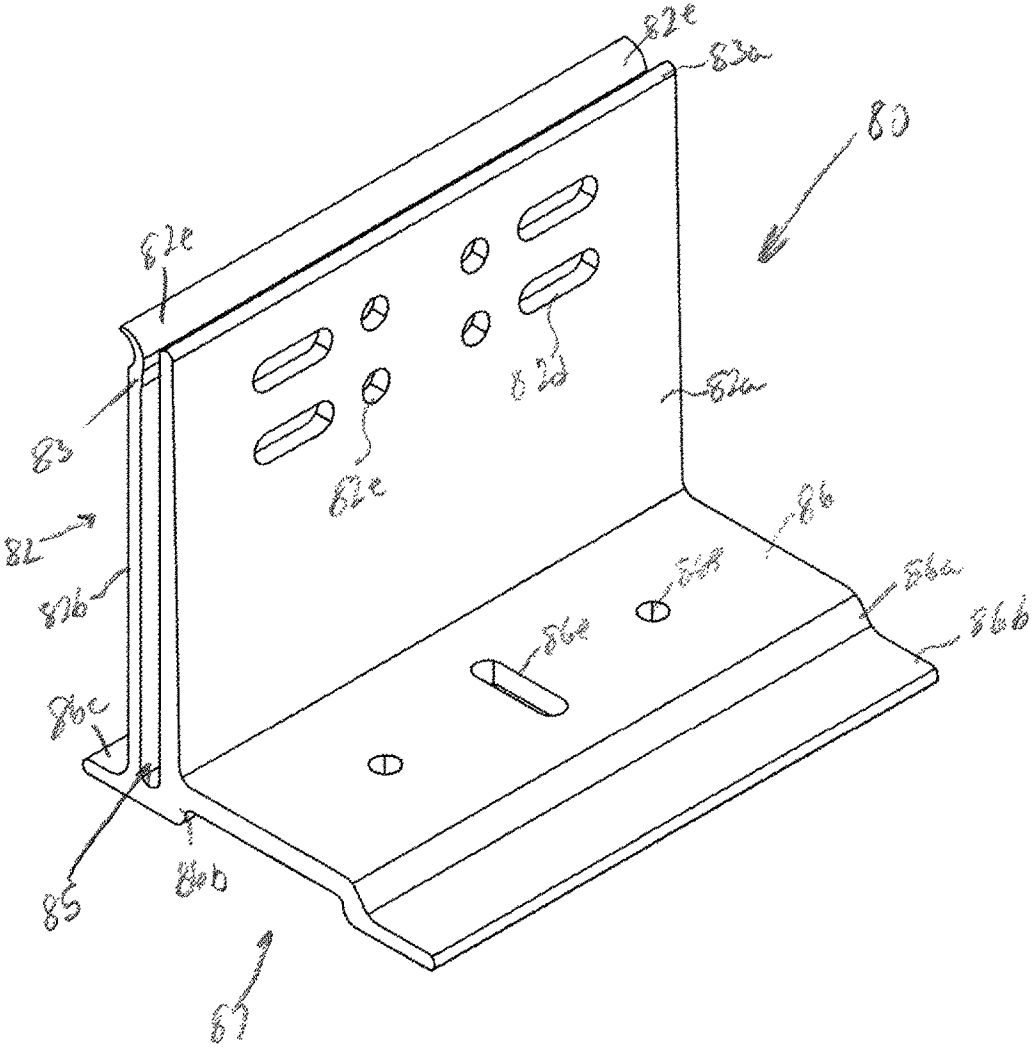
80
82e
82a
82b
82c
82d
82e
82f
82g
82h
82i
82j
82k
82l
82m
82n
82o
82p
82q
82r
82s
82t
82u
82v
82w
82x
82y
82z
82a'
82b'
82c'
82d'
82e'
82f'
82g'
82h'
82i'
82j'
82k'
82l'
82m'
82n'
82o'
82p'
82q'
82r'
82s'
82t'
82u'
82v'
82w'
82x'
82y'
82z'
82a''
82b''
82c''
82d''
82e''
82f''
82g''
82h''
82i''
82j''
82k''
82l''
82m''
82n''
82o''
82p''
82q''
82r''
82s''
82t''
82u''
82v''
82w''
82x''
82y''
82z''
82a'''
82b'''
82c'''
82d'''
82e'''
82f'''
82g'''
82h'''
82i'''
82j'''
82k'''
82l'''
82m'''
82n'''
82o'''
82p'''
82q'''
82r'''
82s'''
82t'''
82u'''
82v'''
82w'''
82x'''
82y'''
82z'''
82a''''
82b''''
82c''''
82d''''
82e''''
82f''''
82g''''
82h''''
82i''''
82j''''
82k''''
82l''''
82m''''
82n''''
82o''''
82p''''
82q''''
82r''''
82s''''
82t''''
82u''''
82v''''
82w''''
82x''''
82y''''
82z''''
82a'''''
82b'''''
82c'''''
82d'''''
82e'''''
82f'''''
82g'''''
82h'''''
82i'''''
82j'''''
82k'''''
82l'''''
82m'''''
82n'''''
82o'''''
82p'''''
82q'''''
82r'''''
82s'''''
82t'''''
82u'''''
82v'''''
82w'''''
82x'''''
82y'''''
82z'''''
82a''''''
82b''''''
82c''''''
82d''''''
82e''''''
82f''''''
82g''''''
82h''''''
82i''''''
82j''''''
82k''''''
82l''''''
82m''''''
82n''''''
82o''''''
82p''''''
82q''''''
82r''''''
82s''''''
82t''''''
82u''''''
82v''''''
82w''''''
82x''''''
82y''''''
82z''''''
82a'''''''
82b'''''''
82c'''''''
82d'''''''
82e'''''''
82f'''''''
82g'''''''
82h'''''''
82i'''''''
82j'''''''
82k'''''''
82l'''''''
82m'''''''
82n'''''''
82o'''''''
82p'''''''
82q'''''''
82r'''''''
82s'''''''
82t'''''''
82u'''''''
82v'''''''
82w'''''''
82x'''''''
82y'''''''
82z'''''''
82a''''''''
82b''''''''
82c''''''''
82d''''''''
82e''''''''
82f''''''''
82g''''''''
82h''''''''
82i''''''''
82j''''''''
82k''''''''
82l''''''''
82m''''''''
82n''''''''
82o''''''''
82p''''''''
82q''''''''
82r''''''''
82s''''''''
82t''''''''
82u''''''''
82v''''''''
82w''''''''
82x''''''''
82y''''''''
82z''''''''
82a'''''''''
82b'''''''''
82c'''''''''
82d'''''''''
82e'''''''''
82f'''''''''
82g'''''''''
82h'''''''''
82i'''''''''
82j'''''''''
82k'''''''''
82l'''''''''
82m'''''''''
82n'''''''''
82o'''''''''
82p'''''''''
82q'''''''''
82r'''''''''
82s'''''''''
82t'''''''''
82u'''''''''
82v'''''''''
82w'''''''''
82x'''''''''
82y'''''''''
82z'''''''''
82a''''''''''
82b''''''''''
82c''''''''''
82d''''''''''
82e''''''''''
82f''''''''''
82g''''''''''
82h''''''''''
82i''''''''''
82j''''''''''
82k''''''''''
82l''''''''''
82m''''''''''
82n''''''''''
82o''''''''''
82p''''''''''
82q''''''''''
82r''''''''''
82s''''''''''
82t''''''''''
82u''''''''''
82v''''''''''
82w''''''''''
82x''''''''''
82y''''''''''
82z''''''''''
82a'''''''''''
82b'''''''''''
82c'''''''''''
82d'''''''''''
82e'''''''''''
82f'''''''''''
82g'''''''''''
82h'''''''''''
82i'''''''''''
82j'''''''''''
82k'''''''''''
82l'''''''''''
82m'''''''''''
82n'''''''''''
82o'''''''''''
82p'''''''''''
82q'''''''''''
82r'''''''''''
82s'''''''''''
82t'''''''''''
82u'''''''''''
82v'''''''''''
82w'''''''''''
82x'''''''''''
82y'''''''''''
82z'''''''''''
82a''''''''''''
82b''''''''''''
82c''''''''''''
82d''''''''''''
82e''''''''''''
82f''''''''''''
82g''''''''''''
82h''''''''''''
82i''''''''''''
82j''''''''''''
82k''''''''''''
82l''''''''''''
82m''''''''''''
82n''''''''''''
82o''''''''''''
82p''''''''''''
82q''''''''''''
82r''''''''''''
82s''''''''''''
82t''''''''''''
82u''''''''''''
82v''''''''''''
82w''''''''''''
82x''''''''''''
82y''''''''''''
82z''''''''''''
82a'''''''''''''
82b'''''''''''''
82c'''''''''''''
82d'''''''''''''
82e'''''''''''''
82f'''''''''''''
82g'''''''''''''
82h'''''''''''''
82i'''''''''''''
82j'''''''''''''
82k'''''''''''''
82l'''''''''''''
82m'''''''''''''
82n'''''''''''''
82o'''''''''''''
82p'''''''''''''
82q'''''''''''''
82r'''''''''''''
82s'''''''''''''
82t'''''''''''''
82u'''''''''''''
82v'''''''''''''
82w'''''''''''''
82x'''''''''''''
82y'''''''''''''
82z'''''''''''''
82a''''''''''''''
82b''''''''''''''
82c''''''''''''''
82d''''''''''''''
82e''''''''''''''
82f''''''''''''''
82g''''''''''''''
82h''''''''''''''
82i''''''''''''''
82j''''''''''''''
82k''''''''''''''
82l''''''''''''''
82m''''''''''''''
82n''''''''''''''
82o''''''''''''''
82p''''''''''''''
82q''''''''''''''
82r''''''''''''''
82s''''''''''''''
82t''''''''''''''
82u''''''''''''''
82v''''''''''''''
82w''''''''''''''
82x''''''''''''''
82y''''''''''''''
82z''''''''''''''
82a'''''''''''''''
82b'''''''''''''''
82c'''''''''''''''
82d'''''''''''''''
82e'''''''''''''''
82f'''''''''''''''
82g'''''''''''''''
82h'''''''''''''''
82i'''''''''''''''
82j'''''''''''''''
82k'''''''''''''''
82l'''''''''''''''
82m'''''''''''''''
82n'''''''''''''''
82o'''''''''''''''
82p'''''''''''''''
82q'''''''''''''''
82r'''''''''''''''
82s'''''''''''''''
82t'''''''''''''''
82u'''''''''''''''
82v'''''''''''''''
82w'''''''''''''''
82x'''''''''''''''
82y'''''''''''''''
82z'''''''''''''''
82a''''''''''''''''
82b''''''''''''''''
82c''''''''''''''''
82d''''''''''''''''
82e''''''''''''''''
82f''''''''''''''''
82g''''''''''''''''
82h''''''''''''''''
82i''''''''''''''''
82j''''''''''''''''
82k''''''''''''''''
82l''''''''''''''''
82m''''''''''''''''
82n''''''''''''''''
82o''''''''''''''''
82p''''''''''''''''
82q''''''''''''''''
82r''''''''''''''''
82s''''''''''''''''
82t''''''''''''''''
82u''''''''''''''''
82v''''''''''''''''
82w''''''''''''''''
82x''''''''''''''''
82y''''''''''''''''
82z''''''''''''''''
82a'''''''''''''''''
82b'''''''''''''''''
82c'''''''''''''''''
82d'''''''''''''''''
82e'''''''''''''''''
82f'''''''''''''''''
82g'''''''''''''''''
82h'''''''''''''''''
82i'''''''''''''''''
82j'''''''''''''''''
82k'''''''''''''''''
82l'''''''''''''''''
82m'''''''''''''''''
82n'''''''''''''''''
82o'''''''''''''''''
82p'''''''''''''''''
82q'''''''''''''''''
82r'''''''''''''''''
82s'''''''''''''''''
82t'''''''''''''''''
82u'''''''''''''''''
82v'''''''''''''''''
82w'''''''''''''''''
82x'''''''''''''''''
82y'''''''''''''''''
82z'''''''''''''''''
82a''''''''''''''''''
82b''''''''''''''''''
82c''''''''''''''''''
82d''''''''''''''''''
82e''''''''''''''''''
82f''''''''''''''''''
82g''''''''''''''''''
82h''''''''''''''''''
82i''''''''''''''''''
82j''''''''''''''''''
82k''''''''''''''''''
82l''''''''''''''''''
82m''''''''''''''''''
82n''''''''''''''''''
82o''''''''''''''''''
82p''''''''''''''''''
82q''''''''''''''''''
82r''''''''''''''''''
82s''''''''''''''''''
82t''''''''''''''''''
82u''''''''''''''''''
82v''''''''''''''''''
82w''''''''''''''''''
82x''''''''''''''''''
82y''''''''''''''''''
82z''''''''''''''''''
82a'''''''''''''''''''
82b'''''''''''''''''''
82c'''''''''''''''''''
82d'''''''''''''''''''
82e'''''''''''''''''''
82f'''''''''''''''''''
82g'''''''''''''''''''
82h'''''''''''''''''''
82i'''''''''''''''''''
82j'''''''''''''''''''
82k'''''''''''''''''''
82l'''''''''''''''''''
82m'''''''''''''''''''
82n'''''''''''''''''''
82o'''''''''''''''''''
82p'''''''''''''''''''
82q'''''''''''''''''''
82r'''''''''''''''''''
82s'''''''''''''''''''
82t'''''''''''''''''''
82u'''''''''''''''''''
82v'''''''''''''''''''
82w'''''''''''''''''''
82x'''''''''''''''''''
82y'''''''''''''''''''
82z'''''''''''''''''''
82a''''''''''''''''''''
82b''''''''''''''''''''
82c''''''''''''''''''''
82d''''''''''''''''''''
82e''''''''''''''''''''
82f''''''''''''''''''''
82g''''''''''''''''''''
82h''''''''''''''''''''
82i''''''''''''''''''''
82j''''''''''''''''''''
82k''''''''''''''''''''
82l''''''''''''''''''''
82m''''''''''''''''''''
82n''''''''''''''''''''
82o''''''''''''''''''''
82p''''''''''''''''''''
82q''''''''''''''''''''
82r''''''''''''''''''''
82s''''''''''''''''''''
82t''''''''''''''''''''
82u''''''''''''''''''''
82v''''''''''''''''''''
82w''''''''''''''''''''
82x''''''''''''''''''''
82y''''''''''''''''''''
82z''''''''''''''''''''
82a'''''''''''''''''''''
82b'''''''''''''''''''''
82c'''''''''''''''''''''
82d'''''''''''''''''''''
82e'''''''''''''''''''''
82f'''''''''''''''''''''
82g'''''''''''''''''''''
82h'''''''''''''''''''''
82i'''''''''''''''''''''
82j'''''''''''''''''''''
82k'''''''''''''''''''''
82l'''''''''''''''''''''
82m'''''''''''''''''''''
82n'''''''''''''''''''''
82o'''''''''''''''''''''
82p'''''''''''''''''''''
82q'''''''''''''''''''''
82r'''''''''''''''''''''
82s'''''''''''''''''''''
82t'''''''''''''''''''''
82u'''''''''''''''''''''
82v'''''''''''''''''''''
82w'''''''''''''''''''''
82x'''''''''''''''''''''
82y'''''''''''''''''''''
82z'''''''''''''''''''''
82a''''''''''''''''''''''
82b''''''''''''''''''''''
82c''''''''''''''''''''''
82d''''''''''''''''''''''
82e''''''''''''''''''''''
82f''''''''''''''''''''''
82g''''''''''''''''''''''
82h''''''''''''''''''''''
82i''''''''''''''''''''''
82j''''''''''''''''''''''
82k''''''''''''''''''''''
82l''''''''''''''''''''''
82m''''''''''''''''''''''
82n''''''''''''''''''''''
82o''''''''''''''''''''''
82p''''''''''''''''''''''
82q''''''''''''''''''''''
82r''''''''''''''''''''''
82s''''''''''''''''''''''
82t''''''''''''''''''''''
82u''''''''''''''''''''''
82v''''''''''''''''''''''
82w''''''''''''''''''''''
82x''''''''''''''''''''''
82y''''''''''''''''''''''
82z''''''''''''''''''''''
82a'''''''''''''''''''''''
82b'''''''''''''''''''''''
82c'''''''''''''''''''''''
82d'''''''''''''''''''''''
82e'''''''''''''''''''''''
82f'''''''''''''''''''''''
82g'''''''''''''''''''''''
82h'''''''''''''''''''''''
82i'''''''''''''''''''''''
82j'''''''''''''''''''''''
82k'''''''''''''''''''''''
82l'''''''''''''''''''''''
82m'''''''''''''''''''''''
82n'''''''''''''''''''''''
82o'''''''''''''''''''''''
82p'''''''''''''''''''''''
82q'''''''''''''''''''''''
82r'''''''''''''''''''''''
82s'''''''''''''''''''''''
82t'''''''''''''''''''''''
82u'''''''''''''''''''''''
82v'''''''''''''''''''''''
82w'''''''''''''''''''''''
82x'''''''''''''''''''''''
82y'''''''''''''''''''''''
82z'''''''''''''''''''''''
82a''''''''''''''''''''''''
82b''''''''''''''''''''''''
82c''''''''''''''''''''''''
82d''''''''''''''''''''''''
82e''''''''''''''''''''''''
82f''''''''''''''''''''''''
82g''''''''''''''''''''''''
82h''''''''''''''''''''''''
82i''''''''''''''''''''''''
82j''''''''''''''''''''''''
82k''''''''''''''''''''''''
82l''''''''''''''''''''''''
82m''''''''''''''''''''''''
82n''''''''''''''''''''''''
82o''''''''''''''''''''''''
82p''''''''''''''''''''''''
82q''''''''''''''''''''''''
82r''''''''''''''''''''''''
82s''''''''''''''''''''''''
82t''''''''''''''''''''''''
82u''''''''''''''''''''''''
82v''''''''''''''''''''''''
82w''''''''''''''''''''''''
82x''''''''''''''''''''''''
82y''''''''''''''''''''''''
82z''''''''''''''''''''''''
82a'''''''''''''''''''''''''
82b'''''''''''''''''''''''''
82c'''''''''''''''''''''''''
82d'''''''''''''''''''''''''
82e'''''''''''''''''''''''''
82f'''''''''''''''''''''''''
82g'''''''''''''''''''''''''
82h'''''''''''''''''''''''''
82i'''''''''''''''''''''''''
82j'''''''''''''''''''''''''
82k'''''''''''''''''''''''''
82l'''''''''''''''''''''''''
82m'''''''''''''''''''''''''
82n'''''''''''''''''''''''''
82o'''''''''''''''''''''''''
82p'''''''''''''''''''''''''
82q'''''''''''''''''''''''''
82r'''''''''''''''''''''''''
82s'''''''''''''''''''''''''
82t'''''''''''''''''''''''''
82u'''''''''''''''''''''''''
82v'''''''''''''''''''''''''
82w'''''''''''''''''''''''''
82x'''''''''''''''''''''''''
82y'''''''''''''''''''''''''
82z'''''''''''''''''''''''''
82a''''''''''''''''''''''''''
82b''''''''''''''''''''''''''
82c''''''''''''''''''''''''''
82d''''''''''''''''''''''''''
82e''''''''''''''''''''''''''
82f''''''''''''''''''''''''''
82g''''''''''''''''''''''''''
82h''''''''''''''''''''''''''
82i''''''''''''''''''''''''''
82j''''''''''''''''''''''''''
82k''''''''''''''''''''''''''
82l''''''''''''''''''''''''''
82m''''''''''''''''''''''''''
82n''''''''''''''''''''''''''
82o''''''''''''''''''''''''''
82p''''''''''''''''''''''''''
82q''''''''''''''''''''''''''
82r''''''''''''''''''''''''''
82s''''''''''''''''''''''''''
82t''''''''''''''''''''''''''
82u''''''''''''''''''''''''''
82v''''''''''''''''''''''''''
82w''''''''''''''''''''''''''
82x''''''''''''''''''''''''''
82y''''''''''''''''''''''''''
82z''''''''''''''''''''''''''
82a'''''''''''''''''''''''''''
82b'''''''''''''''''''''''''''
82c'''''''''''''''''''''''''''
82d'''''''''''''''''''''''''''
82e'''''''''''''''''''''''''''
82f'''''''''''''''''''''''''''
82g'''''''''''''''''''''''''''
82h'''''''''''''''''''''''''''
82i'''''''''''''''''''''''''''
82j'''''''''''''''''''''''''''
82k'''''''''''''''''''''''''''
82l'''''''''''''''''''''''''''
82m'''''''''''''''''''''''''''
82n'''''''''''''''''''''''''''
82o'''''''''''''''''''''''''''
82p'''''''''''''''''''''''''''
82q'''''''''''''''''''''''''''
82r'''''''''''''''''''''''''''
82s'''''''''''''''''''''''''''
82t'''''''''''''''''''''''''''
82u'''''''''''''''''''''''''''
82v'''''''''''''''''''''''''''
82w'''''''''''''''''''''''''''
82x'''''''''''''''''''''''''''
82y'''''''''''''''''''''''''''
82z'''''''''''''''''''''''''''
82a''''''''''''''''''''''''''''
82b''''''''''''''''''''''''''''
82c''''''''''''''''''''''''''''
82d''''''''''''''''''''''''''''
82e''''''''''''''''''''''''''''
82f''''''''''''''''''''''''''''
82g''''''''''''''''''''''''''''
82h''''''''''''''''''''''''''''
82i''''''''''''''''''''''''''''
82j''''''''''''''''''''''''''''
82k''''''''''''''''''''''''''''
82l''''''''''''''''''''''''''''
82m''''''''''''''''''''''''''''
82n''''''''''''''''''''''''''''
82o''''''''''''''''''''''''''''
82p''''''''''''''''''''''''''''
82q''''''''''''''''''''''''''''
82r''''''''''''''''''''''''''''
82s''''''''''''''''''''''''''''
82t''''''''''''''''''''''''''''
82u''''''''''''''''''''''''''''
82v''''''''''''''''''''''''''''
82w''''''''''''''''''''''''''''
82x''''''''''''''''''''''''''''
82y''''''''''''''''''''''''''''
82z''''''''''''''''''''''''''''
82a'''''''''''''''''''''''''''''
82b'''''''''''''''''''''''''''''
82c'''''''''''''''''''''''''''''
82d'''''''''''''''''''''''''''''
82e'''''''''''''''''''''''''''''
82f'''''''''''''''''''''''''''''
82g'''''''''''''''''''''''''''''
82h'''''''''''''''''''''''''''''
82i'''''''''''''''''''''''''''''
82j'''''''''''''''''''''''''''''
82k'''''''''''''''''''''''''''''
82l'''''''''''''''''''''''''''''
82m'''''''''''''''''''''''''''''
82n'''''''''''''''''''''''''''''
82o'''''''''''''''''''''''''''''
82p'''''''''''''''''''''''''''''
82q'''''''''''''''''''''''''''''
82r'''''''''''''''''''''''''''''
82s'''''''''''''''''''''''''''''
82t'''''''''''''''''''''''''''''
82u'''''''''''''''''''''''''''''
82v'''''''''''''''''''''''''''''
82w'''''''''''''''''''''''''''''
82x'''''''''''''''''''''''''''''
82y'''''''''''''''''''''''''''''
82z'''''''''''''''''''''''''''''
82a''''''''''''''''''''''''''''''
82b''''''''''''''''''''''''''''''
82c''''''''''''''''''''''''''''''
82d''''''''''''''''''''''''''''''
82e''''''''''''''''''''''''''''''
82f''''''''''''''''''''''''''''''
82g''''''''''''''''''''''''''''''
82h''''''''''''''''''''''''''''''
82i''''''''''''''''''''''''''''''
82j''''''''''''''''''''''''''''''
82k''''''''''''''''''''''''''''''
82l''''''''''''''''''''''''''''''
82m''''''''''''''''''''''''''''''
82n''''''''''''''''''''''''''''''
82o''''''''''''''''''''''''''''''
82p''''''''''''''''''''''''''''''
82q''''''''''''''''''''''''''''''
82r''''''''''''''''''''''''''''''
82s''''''''''''''''''''''''''''''
82t''''''''''''''''''''''''''''''
82u''''''''''''''''''''''''''''''
82v''''''''''''''''''''''''''''''
82w''''''''''''''''''''''''''''''
82x''''''''''''''''''''''''''''''
82y''''''''''''''''''''''''''''''
82z''''''''''''''''''''''''''''''
82a'''''''''''''''''''''''''''''''
82b'''''''''''''''''''''''''''''''
82c'''''''''''''''''''''''''''''''
82d'''''''''''''''''''''''''''''''
82e'''''''''''''''''''''''''''''''
82f'''''''''''''''''''''''''''''''
82g'''''''''''''''''''''''''''''''
82h'''''''''''''''''''''''''''''''
82i'''''''''''''''''''''''''''''''
82j'''''''''''''''''''''''''''''''
82k'''''''''''''''''''''''''''''''
82l'''''''''''''''''''''''''''''''
82m'''''''''''''''''''''''''''''''
82n'''''''''''''''''''''''''''''''
82o'''''''''''''''''''''''''''''''
82p'''''''''''''''''''''''''''''''
82q'''''''''''''''''''''''''''''''
82r'''''''''''''''''''''''''''''''
82s'''''''''''''''''''''''''''''''
82t'''''''''''''''''''''''''''''''
82u'''''''''''''''''''''''''''''''
82v'''''''''''''''''''''''''''''''
82w'''''''''''''''''''''''''''''''
82x'''''''''''''''''''''''''''''''
82y'''''''''''''''''''''''''''''''
82z'''''''''''''''''''''''''''''''
82a''''''''''''''''''''''''''''''''
82b''''''''''''''''''''''''''''''''
82c''''''''''''''''''''''''''''''''
82d''''''''''''''''''''''''''''''''
82e''''''''''''''''''''''''''''''''
82f''''''''''''''''''''''''''''''''
82g''''''''''''''''''''''''''''''''
82h''''''''''''''''''''''''''''''''
82i''''''''''''''''''''''''''''''''
82j''''''''''''''''''''''''''''''''
82k''''''''''''''''''''''''''''''''
82l''''''''''''''''''''''''''''''''
82m''''''''''''''''''''''''''''''''
82n''''''''''''''''''''''''''''''''
82o''''''''''''''''''''''''''''''''
82p''''''''''''''''''''''''''''''''
82q''''''''''''''''''''''''''''''''
82r''''''''''''''''''''''''''''''''
82s''''''''''''''''''''''''''''''''
82t''''''''''''''''''''''''''''''''
82u''''''''''''''''''''''''''''''''
82v''''''''''''''''''''''''''''''''
82w''''''''''''''''''''''''''''''''
82x''''''''''''''''''''''''''''''''
82y''''''''''''''''''''''''''''''''
82z''''''''''''''''''''''''''''''''
82a'''''''''''''''''''''''''''''''''
82b'''''''''''''''''''''''''''''''''
82c'''''''''''''''''''''''''''''''''
82d'''''''''''''''''''''''''''''''''
82e'''''''''''''''''''''''''''''''''
82f'''''''''''''''''''''''''''''''''
82g'''''''''''''''''''''''''''''''''
82h'''''''''''''''''''''''''''''''''
82i'''''''''''''''''''''''''''''''''
82j'''''''''''''''''''''''''''''''''
82k'''''''''''''''''''''''''''''''''
82l'''''''''''''''''''''''''''''''''
82m'''''''''''''''''''''''''''''''''
82n'''''''''''''''''''''''''''''''''
82o'''''''''''''''''''''''''''''''''
82p'''''''''''''''''''''''''''''''''
82q'''''''''''''''''''''''''''''''''
82r'''''''''''''''''''''''''''''''''
82s'''''''''''''''''''''''''''''''''
82t'''''''''''''''''''''''''''''''''
82u'''''''''''''''''''''''''''''''''
82v'''''''''''''''''''''''''''''''''
82w'''''''''''''''''''''''''''''''''
82x'''''''''''''''''''''''''''''''''
82y'''''''''''''''''''''''''''''''''
82z'''''''''''''''''''''''''''''''''
82a''''''''''''''''''''''''''''''''''
82b''''''''''''''''''''''''''''''''''
82c''''''''''''''''''''''''''''''''''
82d''''''''''''''''''''''''''''''''''
82e''''''''''''''''''''''''''''''''''
82f''''''''''''''''''''''''''''''''''
82g''''''''''''''''''''''''''''''''''
82h''''''''''''''''''''''''''''''''''
82i''''''''''''''''''''''''''''''''''
82j''''''''''''''''''''''''''''''''''
82k''''''''''''''''''''''''''''''''''
82l''''''''''''''''''''''''''''''''''
82m''''''''''''''''''''''''''''''''''
82n''''''''''''''''''''''''''''''''''
82o''''''''''''''''''''''''''''''''''
82p''''''''''''''''''''''''''''''''''
82q''''''''''''''''''''''''''''''''''
82r''''''''''''''''''''''''''''''''''
82s''''''''''''''''''''''''''''''''''
82t''''''''''''''''''''''''''''''''''
82u''''''''''''''''''''''''''''''''''
82v''''''''''''''''''''''''''''''''''
82w''''''''''''''''''''''''''''''''''
82x''''''''''''''''''''''''''''''''''
82y''''''''''''''''''''''''''''''''''
82z''''''''''''''''''''''''''''''''''
82a'''''''''''''''''''''''''''''''''''
82b'''''''''''''''''''''''''''''''''''
82c'''''''''''''''''''''''''''''''''''
82d'''''''''''''''''''''''''''''''''''
82e'''''''''''''''''''''''''''''''''''
82f'''''''''''''''''''''''''''''''''''
82g'''''''''''''''''''''''''''''''''''
82h'''''''''''''''''''''''''''''''''''
82i'''''''''''''''''''''''''''''''''''
82j'''''''''''''''''''''''''''''''''''
82k'''''''''''''''''''''''''''''''''''
82l'''''''''''''''''''''''''''''''''''
82m'''''''''''''''''''''''''''''''''''
82n'''''''''''''''''''''''''''''''''''
82o'''''''''''''''''''''''''''''''''''
82p'''''''''''''''''''''''''''''''''''
82q'''''''''''''''''''''''''''''''''''
82r'''''''''''''''''''''''''''''''''''
82s'''''''''''''''''''''''''''''''''''
82t'''''''''''''''''''''''''''''''''''
82u'''''''''''''''''''''''''''''''''''
82v'''''''''''''''''''''''''''''''''''
82w'''''''''''''''''''''''''''''''''''
82x'''''''''''''''''''''''''''''''''''
82y'''''''''''''''''''''''''''''''''''
82z'''''''''''''''''''''''''''''''''''
82a''''''''''''''''''''''''''''''''''''
82b''''''''''''''''''''''''''''''''''''
82c''''''''''''''''''''''''''''''''''''
82d''''''''''''''''''''''''''''''''''''
82e''''''''''''''''''''''''''''''''''''
82f''''''''''''''''''''''''''''''''''''
82g''''''''''''''''''''''''''''''''''''
82h''''''''''''''''''''''''''''''''''''
82i''''''''''''''''''''''''''''''''''''
82j''''''''''''''''''''''''''''''''''''
82k''''''''''''''''''''''''''''''''''''
82l''''''''''''''''''''''''''''''''''''
82m''''''''''''''''''''''''''''''''''''
82n''''''''''''''''''''''''''''''''''''
82o''''''''''''''''''''''''''''''''''''
82p''''''''''''''''''''''''''''''''''''
82q''''''''''''''''''''''''''''''''''''
82r''''''''''''''''''''''''''''''''''''
82s''''''''''''''''''''''''''''''''''''
82t''''''''''''''''''''''''''''''''''''
82u''''''''''''''''''''''''''''''''''''
82v''''''''''''''''''''''''''''''''''''
82w''''''''''''''''''''''''''''''''''''
82x''''''''''''''''''''''''''''''''''''
82y''''''''''''''''''''''''''''''''''''
82z''''''''''''''''''''''''''''''''''''
82a'''''''''''''''''''''''''''''''''''''
82b'''''''''''''''''''''''''''''''''''''
82c'''''''''''''''''''''''''''''''''''''
82d'''''''''''''''''''''''''''''''''''''
82e'''''''''''''''''''''''''''''''''''''
82f'''''''''''''''''''''''''''''''''''''
82g'''''''''''''''''''''''''''''''''''''
82h'''''''''''''''''''''''''''''''''''''
82i'''''''''''''''''''''''''''''''''''''
82j'''''''''''''''''''''''''''''''''''''
82k'''''''''''''''''''''''''''''''''''''
82l'''''''''''''''''''''''''''''''''''''
82m'''''''''''''''''''''''''''''''''''''
82n'''''''''''''''''''''''''''''''''''''
82o'''''''''''''''''''''''''''''''''''''
82p'''''''''''''''''''''''''''''''''''''
82q'''''''''''''''''''''''''''''''''''''
82r'''''''''''''''''''''''''''''''''''''
82s'''''''''''''''''''''''''''''''''''''
82t'''''''''''''''''''''''''''''''''''''
82u'''''''''''''''''''''''''''''''''''''
82v'''''''''''''''''''''''''''''''''''''
82w'''''''''''''''''''''''''''''''''''''
82x'''''''''''''''''''''''''''''''''''''
82y'''''''''''''''''''''''''''''''''''''
82z'''''''''''''''''''''''''''''''''''''
82a''''''''''''''''''''''''''''''''''''''
82b''''''''''''''''''''''''''''''''''''''
82c''''''''''''''''''''''''''''''''''''''
82d''''''''''''''''''''''''''''''''''''''
82e''''''''''''''''''''''''''''''''''''''
82f''''''''''''''''''''''''''''''''''''''
82g''''''''''''''''''''''''''''''''''''''
82h''''''''''''''''''''''''''''''''''''''
82i''''''''''''''''''''''''''''''''''''''
82j''''''''''''''''''''''''''''''''''''''
82k''''''''''''''''''''''''''''''''''''''
82l''''''''''''''''''''''''''''''''''''''
82m''''''''''''''''''''''''''''''''''''''
82n''''''''''''''''''''''''''''''''''''''
82o''''''''''''''''''''''''''''''''''''''
82p''''''''''''''''''''''''''''''''''''''
82q''''''''''''''''''''''''''''''''''''''
82r''''''''''''''''''''''''''''''''''''''
82s''''''''''''''''''''''''''''''''''''''
82t''''''''''''''''''''''''''''''''''''''
82u''''''''''''''''''''''''''''''''''''''
82v''''''''''''''''''''''''''''''''''''''
82w''''''''''''''''''''''''''''''''''''''
82x''''''''''''''''''''''''''''''''''''''
82y''''''''''''''''''''''''''''''''''''''
82z''''''''''''''''''''''''''''''''''''''
82a'''''''''''''''''''''''''''''''''''''''
82b'''''''''''''''''''''''''''''''''''''''
82c'''''''''''''''''''''''''''''''''''''''
82d'''''''''''''''''''''''''''''''''''''''
82e'''''''''''''''''''''''''''''''''''''''
82f'''''''''''''''''''''''''''''''''''''''
82g'''''''''''''''''''''''''''''''''''''''
82h'''''''''''''''''''''''''''''''''''''''
82i'''''''''''''''''''''''''''''''''''''''
82j'''''''''''''''''''''''''''''''''''''''
82k'''''''''''''''''''''''''''''''''''''''
82l'''''''''''''''''''''''''''''''''''''''
82m'''''''''''''''''''''''''''''''''''''''
82n'''''''''''''''''''''''''''''''''''''''
82o'''''''''''''''''''''''''''''''''''''''
82p'''''''''''''''''''''''''''''''''''''''
82q'''''''''''''''''''''''''''''''''''''''
82r'''''''''''''''''''''''''''''''''''''''
82s'''''''''''''''''''''''''''''''''''''''
82t'''''''''''''''''''''''''''''''''''''''
82u'''''''''''''''''''''''''''''''''''''''
82v'''''''''''''''''''''''''''''''''''''''
82w'''''''''''''''''''''''''''''''''''''''
82x'''''''''''''''''''''''''''''''''''''''
82y'''''''''''''''''''''''''''''''''''''''
82z'''''''''''''''''''''''''''''''''''''''
82a''''''''''''''''''''''''''''''''''''''''
82b''''''''''''''''''''''''''''''''''''''''
82c''''''''''''''''''''''''''''''''''''''''
82d''''''''''''''''''''''''''''''''''''''''
82e''''''''''''''''''''''''''''''''''''''''
82f''''''''''''''''''''''''''''''''''''''''
82g''''''''''''''''''''''''''''''''''''''''
82h''''''''''''''''''''''''''''''''''''''''
82i''''''''''''''''''''''''''''''''''''''''
82j''''''''''''''''''''''''''''''''''''''''
82k''''''''''''''''''''''''''''''''''''''''
82l''''''''''''''''''''''''''''''''''''''''
82m''''''''''''''''''''''''''''''''''''''''
82n''''''''''''''''''''''''''''''''''''''''
82o''''''''''''''''''''''''''''''''''''''''
82p''''''''''''''''''''''''''''''''''''''''
82q''''''''''''''''''''''''''''''''''''''''
82r''''''''''''''''''''''''''''''''''''''''
82s''''''''''''''''''''''''''''''''''''''''
82t''''''''''''''''''''''''''''''''''''''''
82u''''''''''''''''''''''''''''''''''''''''
82v''''''''''''''''''''''''''''''''''''''''
82w''''''''''''''''''''''''''''''''''''''''
82x''''''''''''''''''''''''''''''''''''''''
82y''''''''''''''''''''''''''''''''''''''''
82z''''''''''''''''''''''''''''''''''''''''
82a'''''''''''''''''''''''''''''''''''''''''
82b'''''''''''''''''''''''''''''''''''''''''
82c'''''''''''''''''''''''''''''''''''''''''
82d'''''''''''''''''''''''''''''''''''''''''
82e'''''''''''''''''''''''''''''''''''''''''
82f'''''''''''''''''''''''''''''''''''''''''
82g'''''''''''''''''''''''''''''''''''''''''
82h'''''''''''''''''''''''''''''''''''''''''
82i'''''''''''''''''''''''''''''''''''''''''
82j'''''''''''''''''''''''''''''''''''''''''
82k'''''''''''''''''''''''''''''''''''''''''
82l'''''''''''''''''''''''''''''''''''''''''
82m'''''''''''''''''''''''''''''''''''''''''
82n'''''''''''''''''''''''''''''''''''''''''
82o'''''''''''''''''''''''''''''''''''''''''
82p'''''''''''''''''''''''''''''''''''''''''
82q'''''''''''''''''''''''''''''''''''''''''
82r'''''''''''''''''''''''''''''''''''''''''
82s'''''''''''''''''''''''''''''''''''''''''
82t'''''''''''''''''''''''''''''''''''''''''
82u'''''''''''''''''''''''''''''''''''''''''
82v'''''''''''''''''''''''''''''''''''''''''
82w'''''''''''''''''''''''''''''''''''''''''
82x'''''''''''''''''''''''''''''''''''''''''
82y'''''''''''''''''''''''''''''''''''''''''
82z'''''''''''''''''''''''''''''''''''''''''
82a''''''''''''''''''''''''''''''''''''''''''
82b''''''''''''''''''''''''''''''''''''''''''
82c''''''''''''''''''''''''''''''''''''''''''
82d''''''''''''''''''''''''''''''''''''''''''
82e''''''''''''''''''''''''''''''''''''''''''
82f''''''''''''''''''''''''''''''''''''''''''
82g''''''''''''''''''''''''''''''''''''''''''
82h''''''''''''''''''''''''''''''''''''''''''
82i''''''''''''''''''''''''''''''''''''''''''
82j''''''''''''''''''''''''''''''''''''''''''
82k''''''''''''''''''''''''''''''''''''''''''
82l''''''''''''''''''''''''''''''''''''''''''
82m''''''''''''''''''''''''''''''''''''''''''
82n''''''''''''''''''''''''''''''''''''''''''
82o''''''''''''''''''''''''''''''''''''''''''
82p''''''''''''''''''''''''''''''''''''''''''
82q''''''''''''''''''''''''''''''''''''''''''
82r''''''''''''''''''''''''''''''''''''''''''
82s''''''''''''''''''''''''''''''''''''''''''
82t''''''''''''''''''''''''''''''''''''''''''
82u''''''''''''''''''''''''''''''''''''''''''
82v''''''''''''''''''''''''''''''''''''''''''
82w''''''''''''''''''''''''''''''''''''''''''
82x''''''''''''''''''''''''''''''''''''''''''
82y''''''''''''''''''''''''''''''''''''''''''
82z''''''''''''''''''''''''''''''''''''''''''
82a'''''''''''''''''''''''''''''''''''''''''''
82b'''''''''''''''''''''''''''''''''''''''''''
82c'''''''''''''''''''''''''''''''''''''''''''
82d'''''''''''''''''''''''''''''''''''''''''''
82e'''''''''''''''''''''''''''''''''''''''''''
82f'''''''''''''''''''''''''''''''''''''''''''
82g'''''''''''''''''''''''''''''''''''''''''''
82h'''''''''''''''''''''''''''''''''''''''''''
82i'''''''''''''''''''''''''''''''''''''''''''
82j'''''''''''''''''''''''''''''''''''''''''''
82k'''''''''''''''''''''''''''''''''''''''''''
82l'''''''''''''''''''''''''''''''''''''''''''
82m'''''''''''''''''''''''''''''''''''''''''''
82n'''''''''''''''''''''''''''''''''''''''''''
82o'''''''''''''''''''''''''''''''''''''''''''
82p'''''''''''''''''''''''''''''''''''''''''''
82q'''''''''''''''''''''''''''''''''''''''''''
82r'''''''''''''''''''''''''''''''''''''''''''
82s'''''''''''''''''''''''''''''''''''''''''''
82t'''''''''''''''''''''''''''

SYSTEM FOR MOUNTING WALL PANELS ONTO A WALL OR FLOOR SLABS

FIELD OF THE INVENTION

The present invention relates to a system and method of mounting exterior wall panels onto existing structures such as existing walls and/or exposed floor slabs.

BACKGROUND OF THE INVENTION

The present invention relates generally to a wall system, and more particularly, to a system for easily mounting wall panels over an existing wall.

In order to enhance the look of a wall structure, it is known to secure wall panels to the wall structure. However, the securement of wall panels to the wall structure is generally a long and tedious job since it entails using fastening devices such as nails and/or screws to secure the walls panels directly to the wall structure.

A similar need exists when installing a façade onto a exposed floor slab. The process of securing façade to a floor slab or another portion of exterior wall involves an independent operation for each floor. Thus each new panel is independently mounted onto a slab and then linked with other panels using grout or caulking and then decorative panels that are designed to mask or hide seams. There is presently no system of installing exterior panels that is reproducible irrespective of a particular building layout requirements.

When securing the wall panels to an existing wall or floor slab, precise measurements must be taken and the wall panels must be precisely positioned. This is time consuming and tedious. Further, if a mistake is made as to the positioning of one wall panel, this will affect the positioning of the remaining wall panels and may result in removing the misaligned wall panels and re-securing these wall panels correctly in position. In addition, no consideration is taken for any unevenness in the existing wall.

It would therefore be desirable to provide wall panels that can be positioned and adjusted on the existing wall during assembly.

SUMMARY OF THE INVENTION

It is an object of the present invention to provide a system and method for easily mounting wall panels over an existing wall that overcomes the aforementioned problems.

It is another object of the present invention to provide a system and method for easily mounting panels of a façade onto exposed slab edges of existing flooring, while permitting adjustment of the position of the wall panels in three dimensions.

It is still another object of the present invention to provide a system and method for mounting wall panels over an existing wall with exact precision.

It is yet another object of the present invention to provide a system and method for easily mounting wall panels over an existing wall which easily captures and restrains ends of the wall panels.

It is a further object of the present invention to provide a system and method for easily mounting a system of wall panels to create a building façade which allows for thermal expansion of the wall panels.

In accordance with an aspect of the present invention, a system for mounting wall panels to an existing wall, includes a plurality of support assemblies adapted to be secured to the exposed surfaces of floor slab or existing wall; a plurality of sliding support members slidably received in the support tracks and adapted to be fixed therein by fasteners; and a plurality of adjustment support members connected with the sliding support members for assembling a building façade over completed floor slabs.

In accordance with another aspect of the present invention, a system for mounting wall panels to an existing wall, includes a plurality of support assemblies adapted to be secured to the exposed surfaces of floor slab or an existing wall; a plurality of sliding support members slidably received in the support track and adapted to be fixed therein by fasteners; a plurality of adjustment support members connected with the sliding support members for mounting the wall panels to the existing wall; and a plurality of connecting panels connecting together spaced apart adjustment support members, with the connecting panels adapted to mount the wall panels to the existing wall, the connecting panels including an end connecting panel bent at an angle to connect adjustment support members oriented at different angles at a corner of the existing wall.

One of the primary objects of the disclosed system is to enable mounting of wall panels or windows on an erected latticework. Such latticework is deployed on exteriors of existing walls or is mounted across floor slabs.

The system is comprised of a plurality of parallel upright assemblies stretching from slab of one floor to slab of the next floor. Crossmembers fastened to the parallel upright assemblies serve as mounting points for wall or window paneling.

It is an object of this invention to provide a system for attaching panels unto an existing wall or exposed floor slabs where the system is not dependent on a particular layout of a floor.

BRIEF DESCRIPTION OF THE DRAWINGS

FIG. 14 is a perspective view of the sliding support member.

DESCRIPTION OF THE PREFERRED EMBODIMENTS

Figure 1:
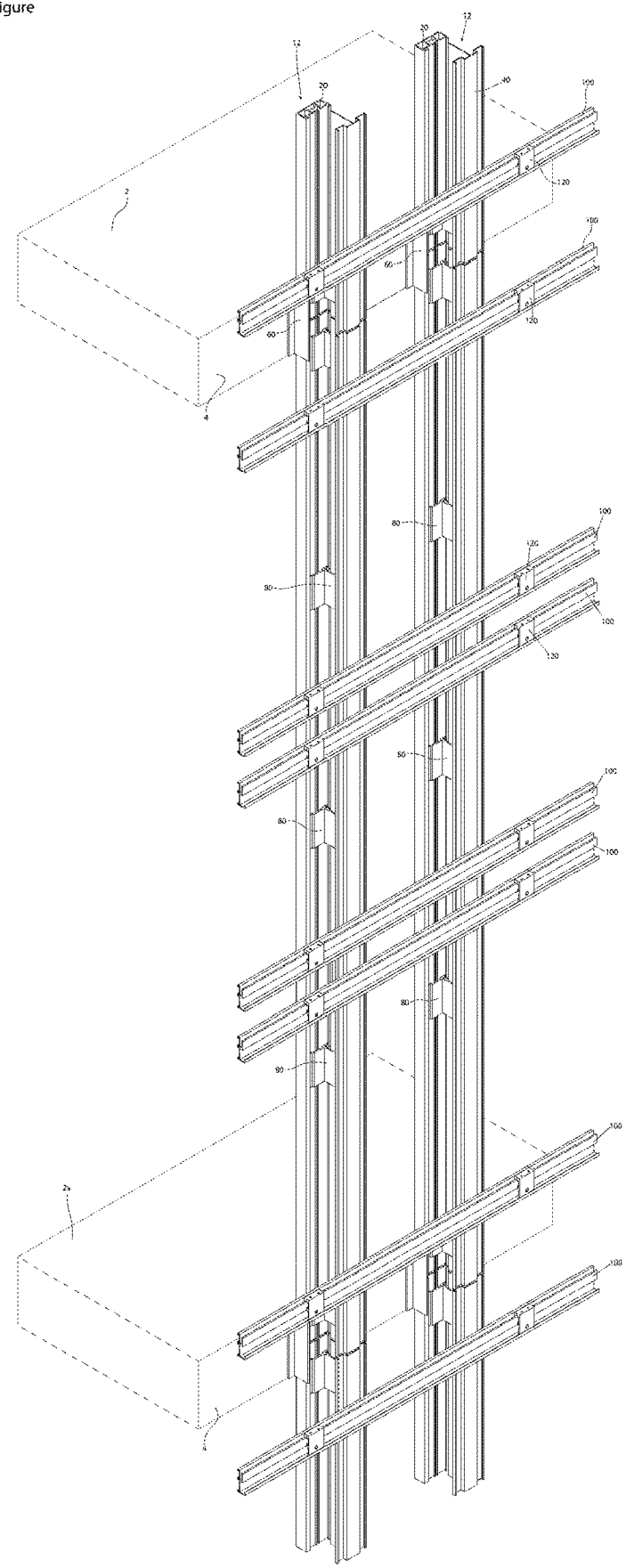
FIG. 1 is a perspective view of the disclosed system that is fully assembled and arranged to support installation of wall and window panels to the floor slabs.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Turning now descriptively to the drawings, in which similar reference characters denote similar elements throughout the several views.

FIG. 1 demonstrates the first assembly of the disclosed system of mounting wall panels unto a wall or floor slabs 2 using the double tee brackets 60. Each double tee bracket 60 is fastened to or along the outer edge 4 of a floor slab 2. A plurality of base support tracks 20 are assembled in a parallel and spaced apart orientation to each other, with double tee bracket 60 and runs vertically, with each section of base support track spanning the distance between the first slab 2*a* and the next slab 2. Assembled with the support track 20 is a slidable member 80 which provides support for the adjustment member 40. The adjustment member 40 is then used to fasten a plurality of spaced apart double L crossmembers 100 which provide a connection point for R-brackets 120. The distance between one double L crossmember 100 and adjacently placed double-L crossmember varies depending on a wall panel used. There may be one or more wall panels used for each floor, for example, stacked combination of a window panel and a wall panel, each supporting by the disclosed assembly shown in FIG. 1 without needing any customization of the disclosed system.

Figure 2:
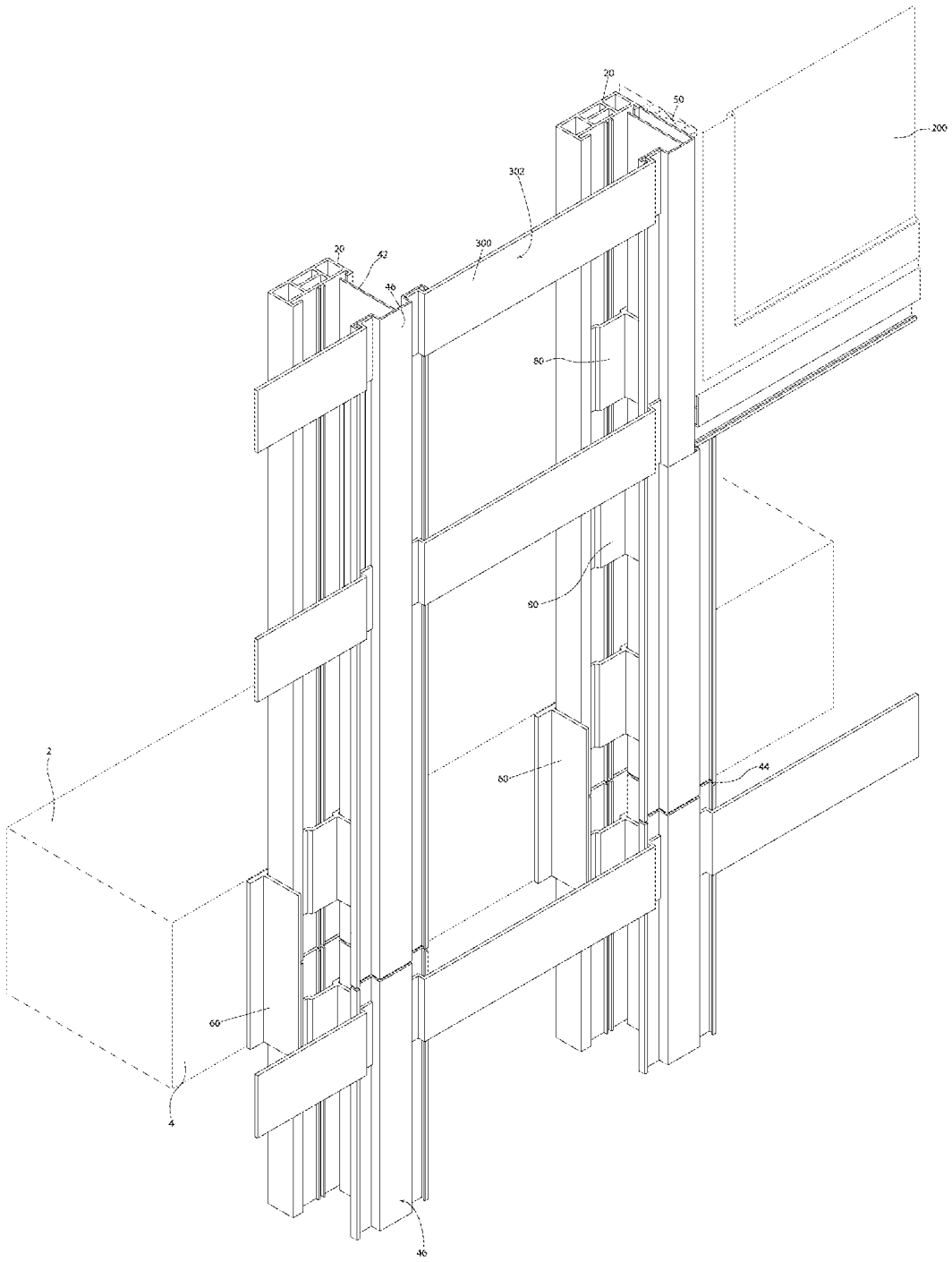
FIG. 2 is a perspective view of the disclosed system featuring alternative components that are assembled and prepared for deployment of wall and window panels unto an existing wall or floor slab.

FIG. 2 demonstrates a second or alternative assembly of the disclosed system of the disclosed system of mounting wall panels unto a wall or floor slabs 2 using the double tee brackets 60. Each double tee bracket 60 is fastened to or along the outer edge 4 of a floor slab 2. A plurality of base support tracks 20 are assembled in a parallel and spaced apart orientation to each other running vertically, with each section of base support track spanning the distance between the first slab 2*a* and the next slab 2. Assembled with the support track is a slidable member 80 which provides support for the adjustment member 40. A plurality of cross members 300 span the horizontal distance between each two adjacent adjustable support members 40. The crossmembers supporting wall panels fastened to the outer surface 302 thereof are integrated with window panels 200. Notably, the double tee bracket 60 functions as a junction for multiple sections of the base track 20 and adjustable support member 40 as illustrated by the seam 44.

Figure 3:
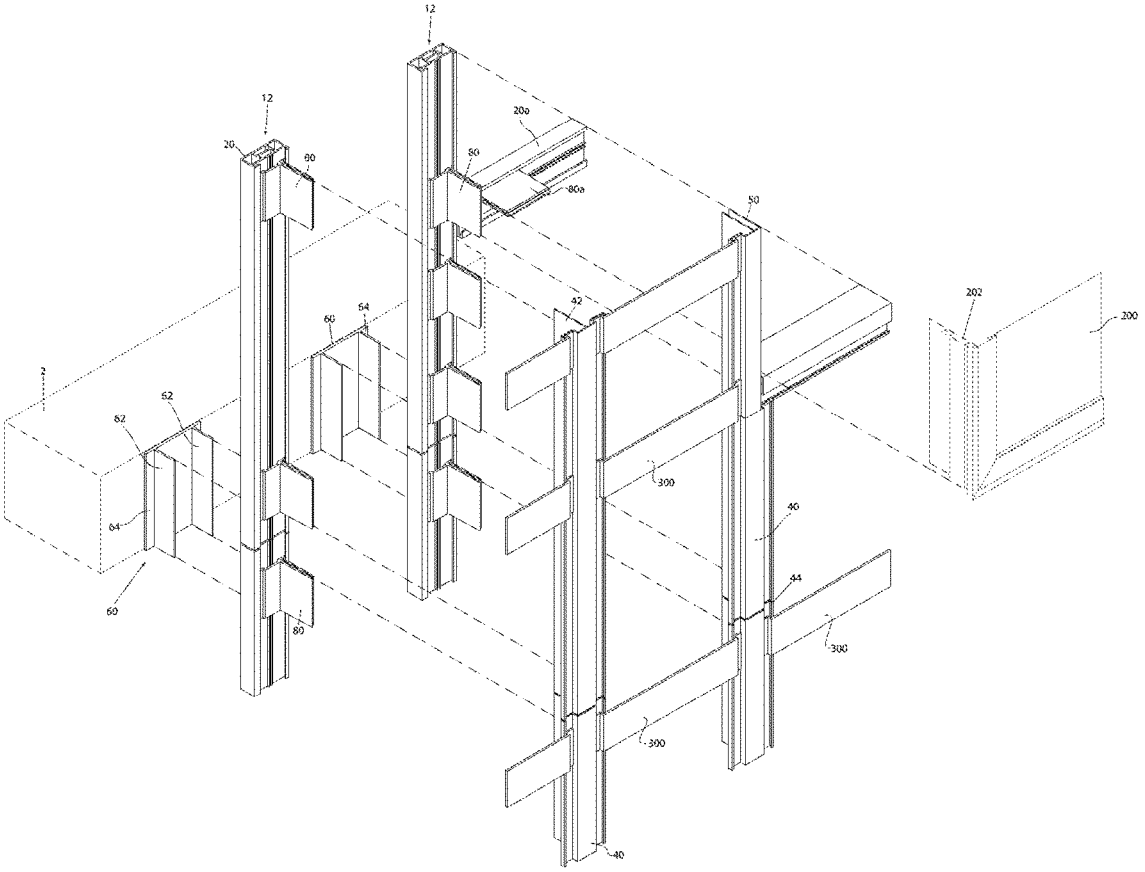
FIG. 3 is a n exploded diagram of the system shown in FIG. 2.
Figure 4:
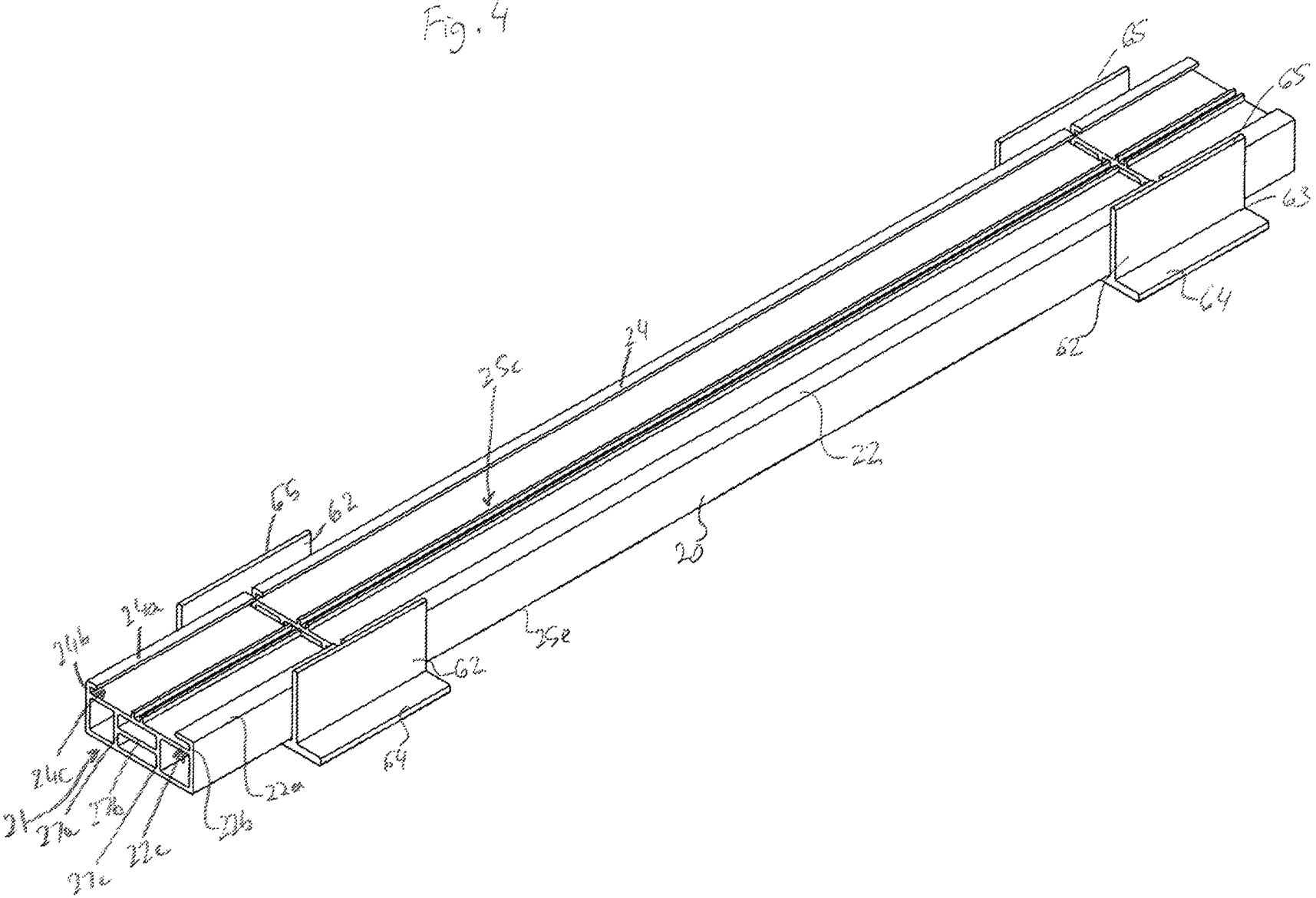
FIG. 4 discloses several sections of the base track mounted within two double tee brackets.

FIG. 3 is an exploded diagram of the system disclosed in FIG. 4 showing a junction of components at floor slab 2. Shown are double tee brackets 60 mounted in a spaced apart and parallel configuration. Mounting in between forwardly protruding at least one wall 62 is a section of the support track 20. The double tee brackets 60 are secured to or along the floor slab edge 4 with screws that are driven through the shoulder section 64. Each section of the support track is then secured between the two parallel forwardly protruding walls 64 with screws that are driven through the forwardly protruding walls 64 toward and into the support tracks 20. Appreciably, the double tee bracket 60 may contain just one forwardly protruding wall 62. Sliding along the support track 20 is a plurality of slidable member 80 which are inserted at any point along the track and are then capable of adjusting up or down along the entire length of the combined sections of the support track 20. The sliding support track 20 is configured to retain the upright elongated panel 42 of the adjustable support member 40. The adjustable support member 40 is shown assembled with a plurality of spaced apart parallel crossmembers 300 that span the distance between two adjacent support assemblies 12. Notably, the support track 20 may be deployed vertically and run from one slab to the next, or horizontally 20*a*, as shown deployed in support of the window support plate 202. Mounting adjacently to the window support plate 202 is the edge adjustable support member 50. The edge adjustable support member 50 is mounted adjacently to a window panel, or at another location along a wall where the latticework or support assemblies must be interrupted with an insertion of a wall/window panel 200.

FIG. 4 presents an assembly of support tracks 20 that run from one double tee bracket 60 to the next double tee bracket 60. The support track is comprised of a bottom surface 25*b*. rising upwardly from the long edge 25*e* on either sides of the bottom surface 25*b* are sidewalls 25. The sidewalls are linked at the top by the top surface 25*a* which rans parallel to the bottom surface 25*b*. Rising out the sidewall 25 are L-walls 22 and 24. The L-wall 22 is comprised of a first wall 22*b*. Extending at an angle, preferably a right angle, from a free end of the first wall 22*b* is the second wall 22*b* which is parallel to and spaced apart from the top surface 25*a*. A U-shaped gap 22*c* is thereby created between the second wall 22*b* and the top surface 25*a*. The L-wall 24 is comprised of a first wall 24*b*. Extending at an angle, preferably a right angle, from a free end of the first wall 24*b* is the second wall 24*b* which is parallel to and spaced apart from the top surface 25*a*. A U-shaped gap 24*c* is thereby created between the second wall 24*b* and the top surface 25*a*. The U-shaped gaps 22*c* and 24*c* are opposite each other. Running substantially along the center of the top surface 25*a* is a groove 25*c* that is used to accept a shaft of a fastener being inserted through the U-shaped base of a slidable support member 80, as will be demonstrated in later figures.

Internal structural members 27*a* are mounted all along the length of the support track 20, supporting the top surface 25*a* above the bottom surface 25*b*. At least one crosswise internal support member 27*b* joins internal structural members 27*a*. The internal cavity 21 may alternatively be completely hollow or completely solid.

Figure 5:
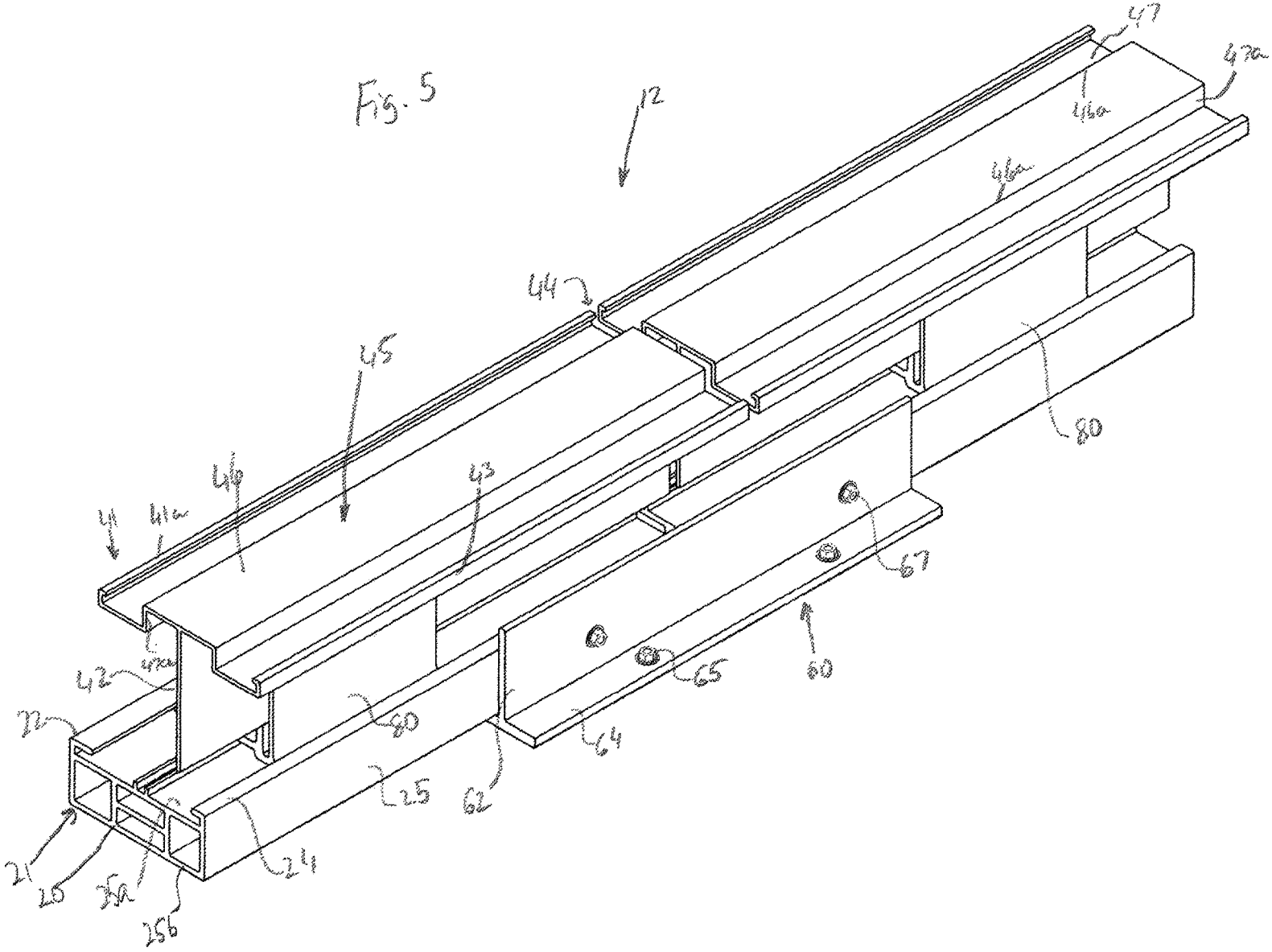
FIGS. 5 and 6 are perspective views of several sections of the base track that is mounted within a double tee bracket. At least two slidable support members deployed on the surface of the base track and assembled with an adjustable support member.
Figure 6:
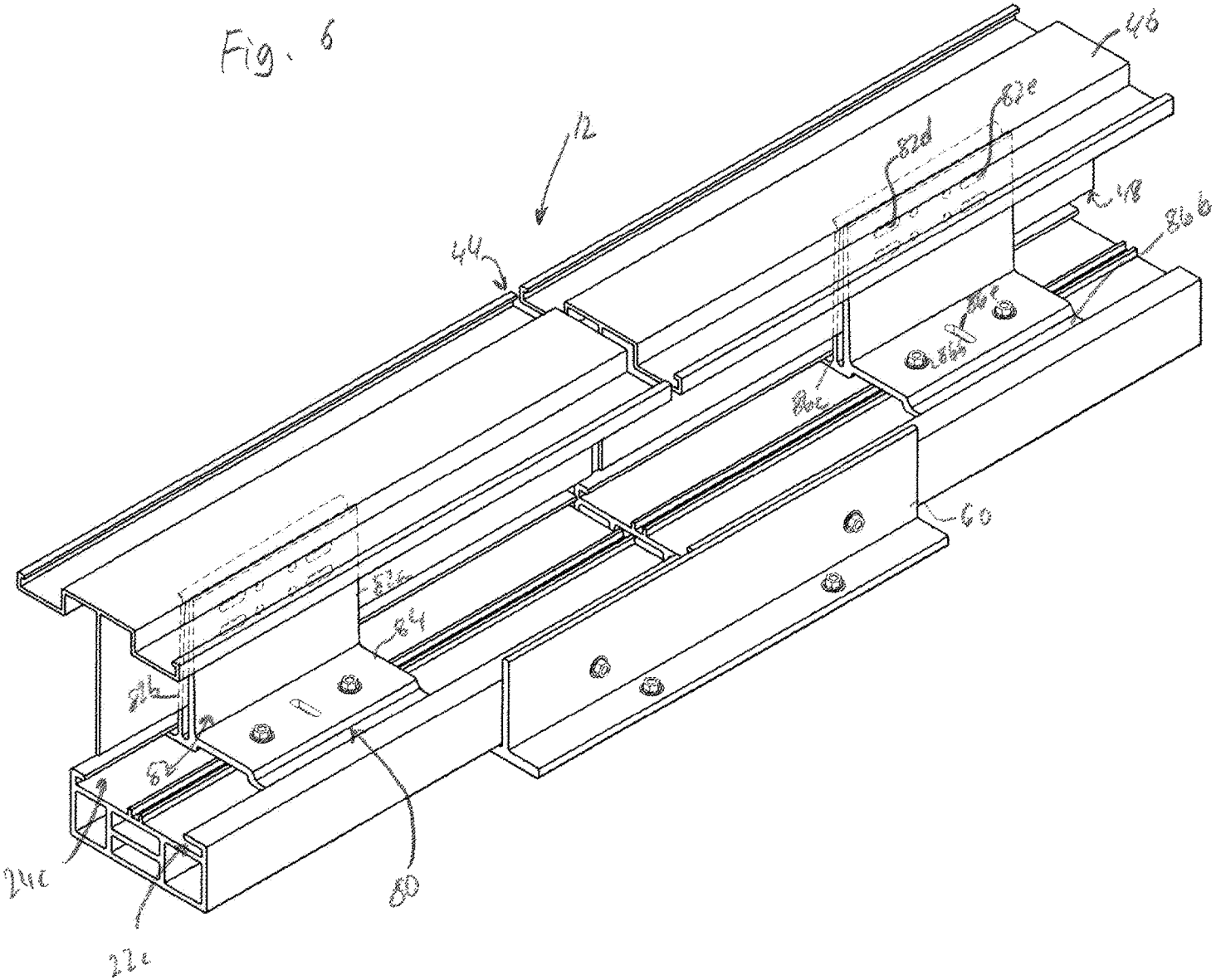

FIGS. 5 and 6 demonstrate the assembly 12. Shown assembled on top of the support track 20 are sliding support members 80. Elongated upright panel 42 of adjustable support members 40 are assembled within the sliding support members 80. Each adjustable support member is comprised of the elongated upright panel 42. A top wall 46 is mounted along one edge of the elongated support panel 42, with the combination of the elongated support panel 42 and top wall 46 forming a "T". Each edge 46*a* of the top wall 46 further comprises a U-shaped channel 47, attaching to the top wall 46 with a wall 47*a*, and having an L-shaped wall 41 along the free edge of the U-shaped channels 47. The seam 44 running between two lengthwise adjacent adjustment support members 40 and support tracks 20 permits for expansion of said members as these expand when the external temperature rises.

FIG. 6 demonstrates the utility of the sliding support member 80. Shown are the upright walls 82 that extend upward at an angle, preferably a right angle, from the surface of the inverted U-shaped plate 84 having wing walls 86*b* and 86*c* slidably retained within the spaces 24*c* and 22*c*, respectively. The fastener openings 86*f* fixate the inverted U-shaped plate 84 along the length of the support track 20.

Notably, the channel 25*c* running along the top surface 25*a* provides a location for fasteners coming through the inverted U-plate 84. In particular, the borders 25*d* add additional surface to capture and retain threading of fastener shaft coming through from openings 86*f* and 86*e*. The channel 25*c* is shown placed centrally to be compatible for the featured sliding support member 80 that is shown but may be place along any portion of the top surface 25*a*. The channel 25*c* is especially useful for a thin support track 20 having only the top surface 25*a*. In a thin support track 20 setting one does not have the luxury of the support track thickness that permits the usage of longer fasteners without the need to drill through the surface underneath. The channel 25*c* provides a similar functionality, allowing installing of sliding support members 80 without the need to drill through underlying surface and deploying anchors therethrough when a thin support track 20 is used.

The sliding support member 80 is installed by inserting the wing portion 86*b* into the space 22*c* and then rotating the sliding support member 80 onto the top surface 25*a* until the second wing portion 86*c* clears the L-wall 24 and is then inserted into the space 24*c*. The sliding support member is then fastened loosely through fasteners within openings 86*d* and then fine-adjusted laterally using the slot 86*e*. Openings on parallel walls 82*a* and 82*b* are used to adjust the orientation of the adjustment support member 40 lengthwise along the support assembly 12.

It should be noted that the sliding support member 80 thermally isolates the adjustable support member 40 from the support track 20. The support member 40 and the support track 20 are preferably made of steel, aluminum or a lightweight metal alloy. The bottom edge 48 of the upright elongated panel 42 is separated from the top surface 24*a*, furthermore, the sliding support member 80 is made of thermally insulating materials such as fiberglass or polyamide and does not transmit temperature from weather exposed surfaces of the adjustable support member 40 to the support track 20.

Figure 7:
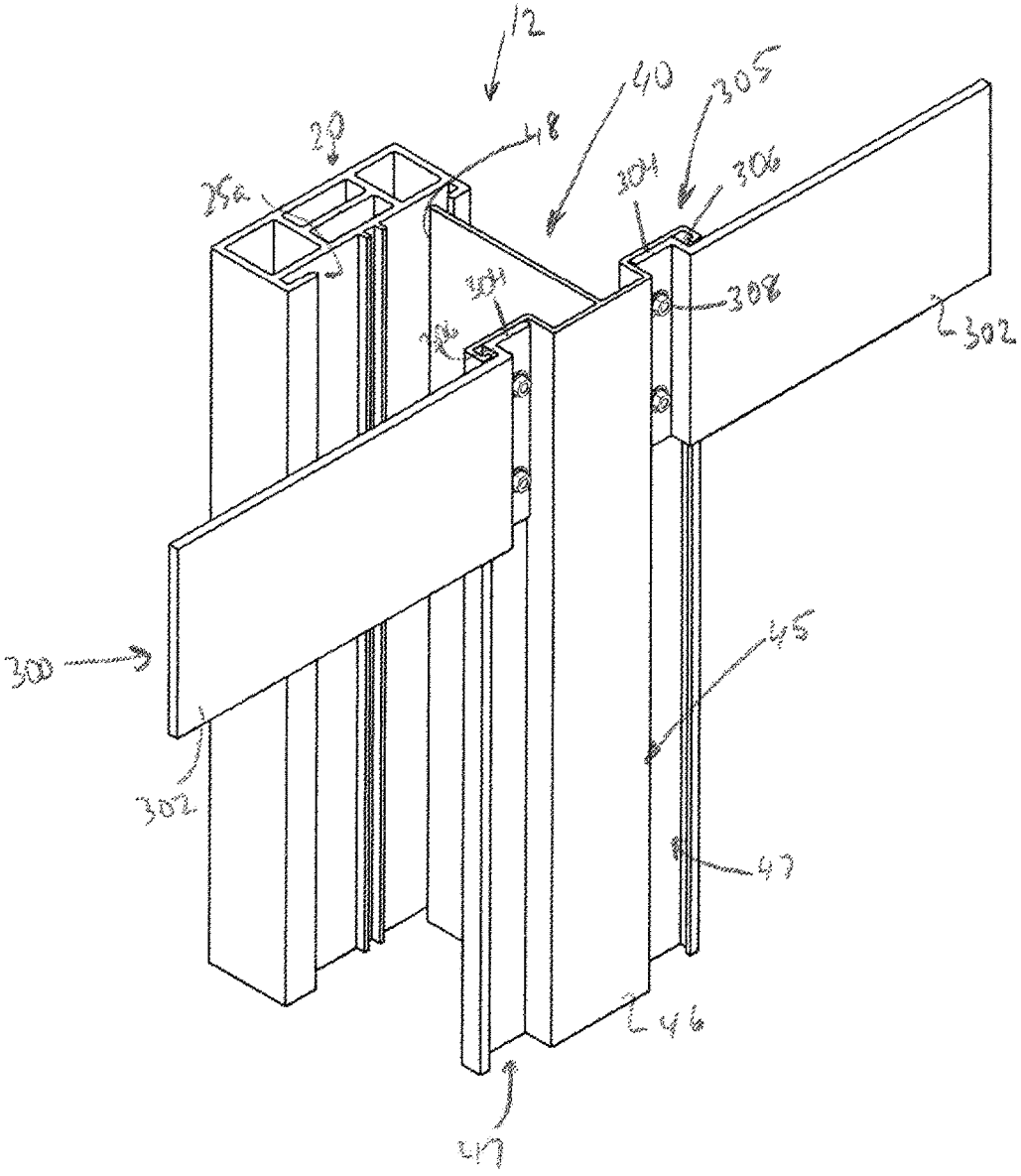
FIG. 7 is a perspective closeup view of a portion of the assembly shown in FIG. 2.

FIG. 7 demonstrates a detailed sectional figure of the support assembly 12 that is shown in FIG. 2. Shown is the base track 20, top surface 25*a*, adjustment support member 40, and the top wall 46. A wing section 305 of each crossmember 300 are attached withing the U-channel 47 of the adjustment support member 40. The crossmembers 300 and the top wall 46 present external outer surfaces 302 and 46 respectively for the mounting of façade panels or wall cladding. The adjustment support member 40 and the support track 20 are preferably at least sufficiently long to link two floor slabs that are one above the other together.

Figure 8:
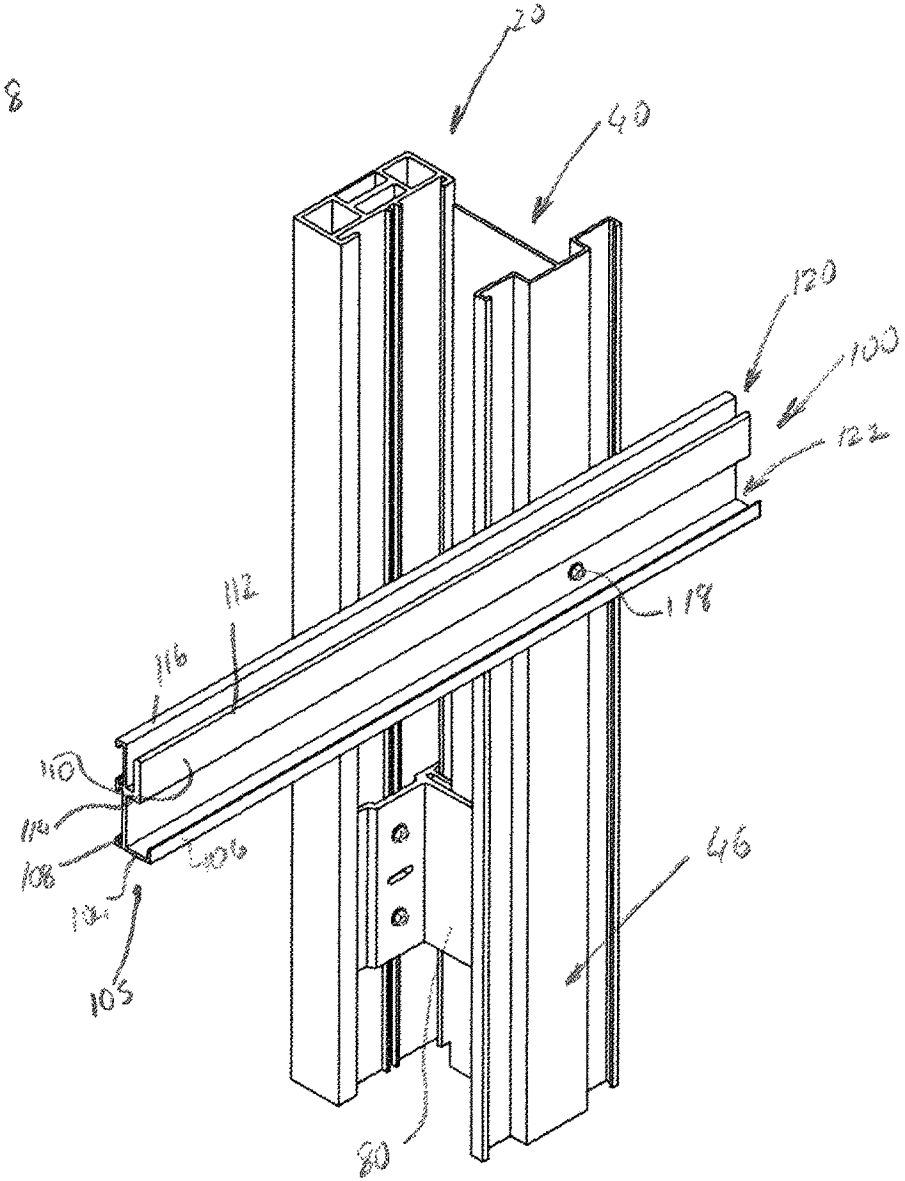
FIG. 8 is a perspective closeup view of a portion of the assembly shown in FIG. 1.

FIG. 8 demonstrates the support assembly 12 having a double L-crossmember 100 fastened to the top wall 46 of the adjustment support member 40. The double L-crossmember 100 is comprised of a backwall 102. Extending forwardly from the bottom edge of the backwall 102 is a first L-wall 105. The first L-wall 105 is comprised of the forwardly extending first wall 104. A second wall 106 extends upward from the free edge of the first wall 104 and is in a parallel spaced apart orientation with the backwall 102, with the first L-wall 105 creating a first channel 122. Above the first L-wall 105 is the second L-wall 110 that is disposed along the height of the backwall 102. The second L-wall 110 is comprised of a third wall 114 extending forwardly along the height of the backwall 108, with the first wall 104 and the third wall 114 being in a parallel and spaced apart configuration with each other. A fourth wall 112 then extends upwardly from a free edge of the third wall 114, with the backwall 102 and the fourth wall 112 being in a parallel and spaced apart configuration with the backwall 102, thereby creating a second channel 120. The first channel 122 being substantially wider than the second channel 120. At least one fastener 118 attaching the double L-crossmember 100 to the top wall 46.

Figure 9:
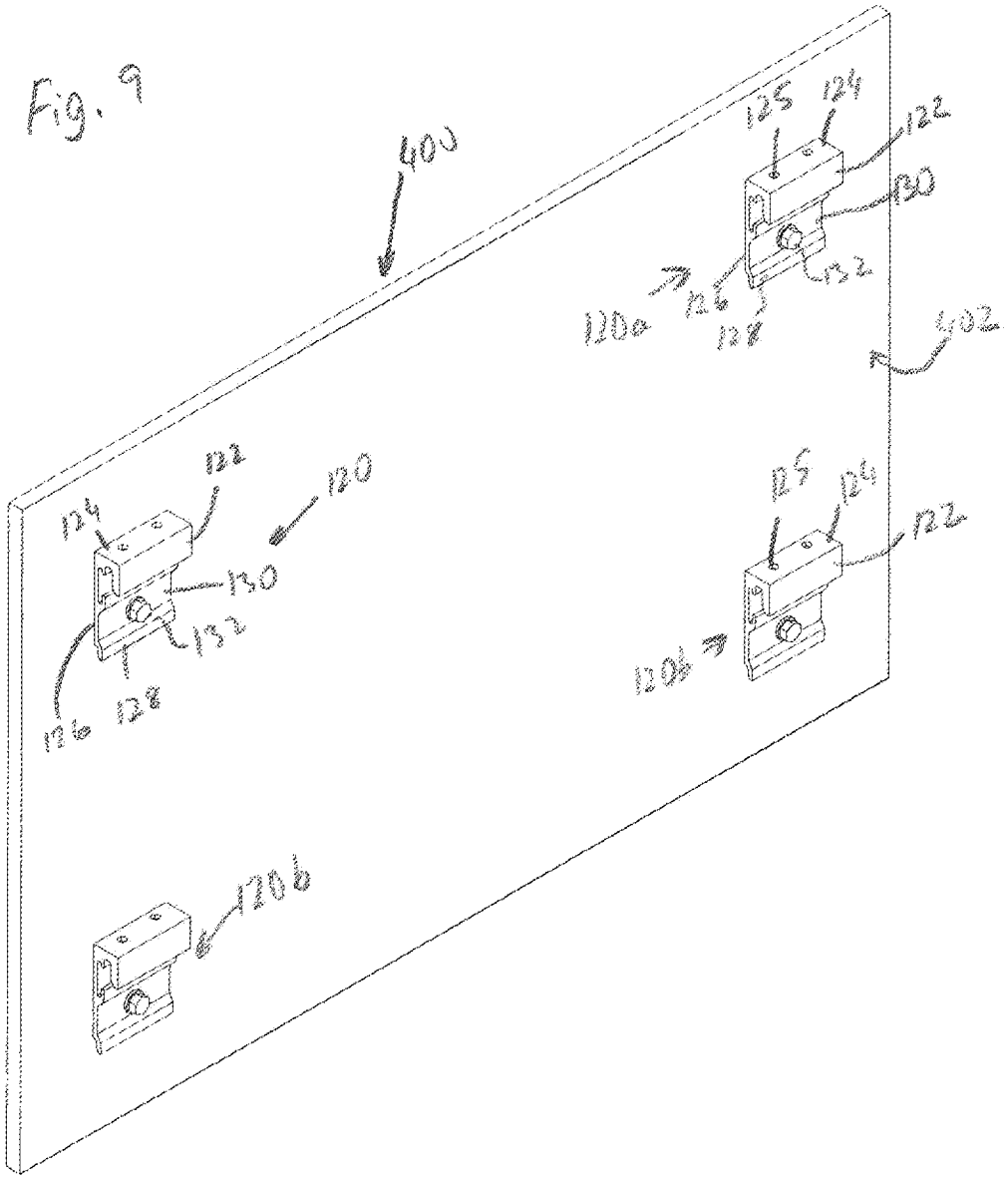
FIG. 9 is a perspective view of a wall or window panel assembled with a plurality of R-brackets.

FIG. 8 is used the mount wall panels thereto. A back surface 402 of a wall panel 400 is shown in FIG. 9. The wall panel 400 may be made of wood, stone, fiberglass, glass or a composite material. A wall panel 440 is hung onto a double-L crossmember 100 with R-brackets 120*a* and 120*b*. The upper R-brackets 120*a* are mounting on a single double-L crossmember 100 or two axial double-L crossmembers 100, with the lower R-brackets 120*b* mounting on a lower double-L crossmember 100. Each R-bracket 120*a* or 120*b* is comprised of a first wall 124. Extending forwardly, preferably at right angle from the first wall 126 is the second wall 124. Extending downward and at an angle, preferably a right angle, from the second wall 124 is the third wall 122. A fifth wall 128 extends from the bottom edge of the first wall 126 is the same axial plane as the first wall 126, but setoff slightly forwardly from the axis of the first wall 126. First wall creates a back surface 130 having a fastener opening 132.

Figure 10:
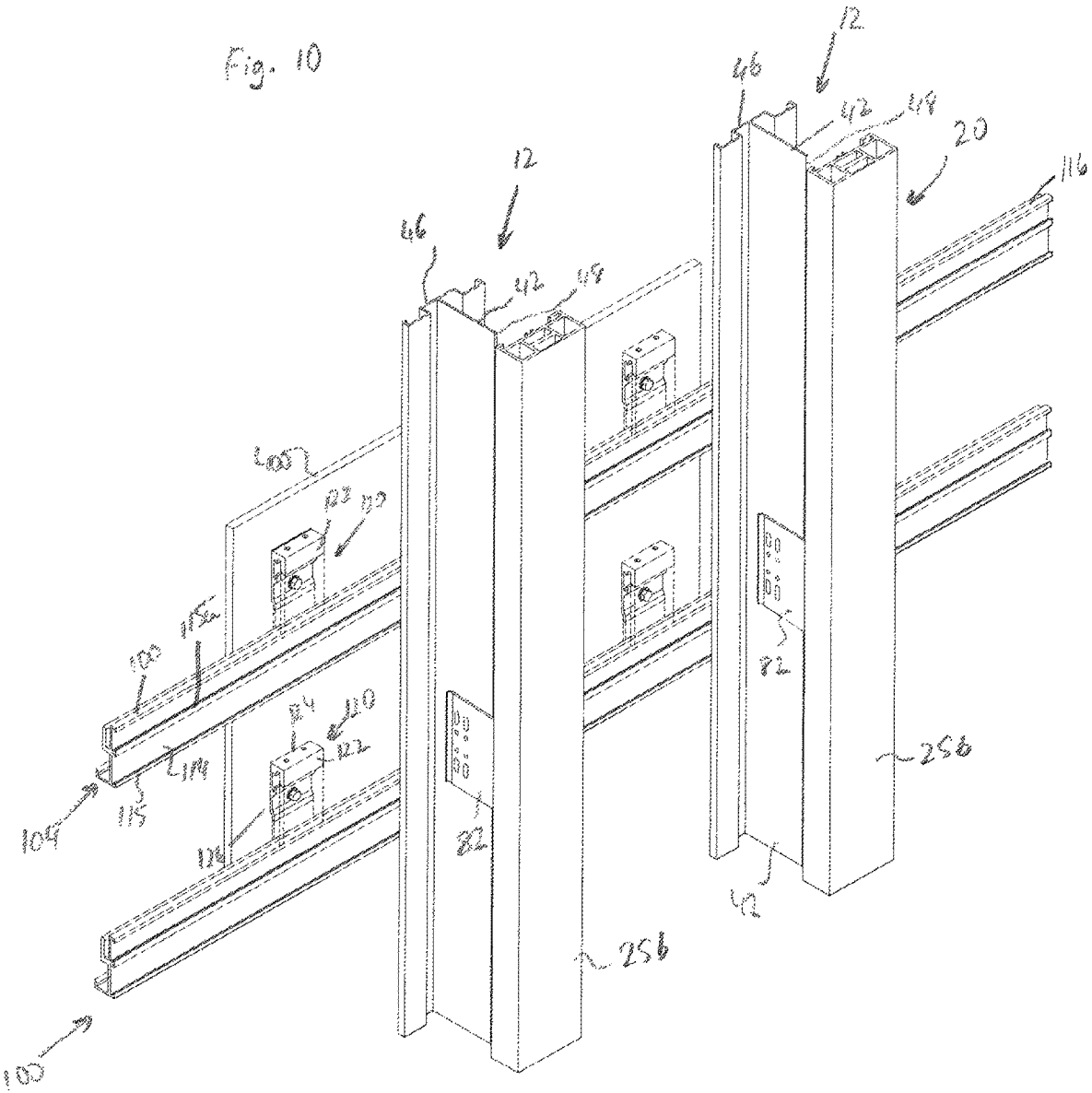
FIG. 10 is a closeup perspective view of a section of the assembly shown in FIG. 1 as viewed from the direction of a floor slab looking out, showing the deployment of a wall or window panel.

FIG. 10 demonstrates the method of mounting a wall panel 400 onto a double-L crossmember 100 using R brackets 120. Appreciably, the double-L crossmember 100 may be a single-L or a triple-L crossmember, depending on weight or other considerations of mounting a wall panel 400. The double-L crossmember 100 provides a rearwardly extending top wall 116 extending from the top edge of the backwall 108. The top wall 116 is used to fasten the R-brackets 120 using the fastener openings 125, or without fastener openings, the second wall 124 attached to the top wall 116 with at least one fastener driven therethrough. The double-L crossmember 100 further contains strength ribs 115 and 115*a* running along the back surface 114 and being co-planar as the first wall 108 and the third wall 114.

Figure 11:
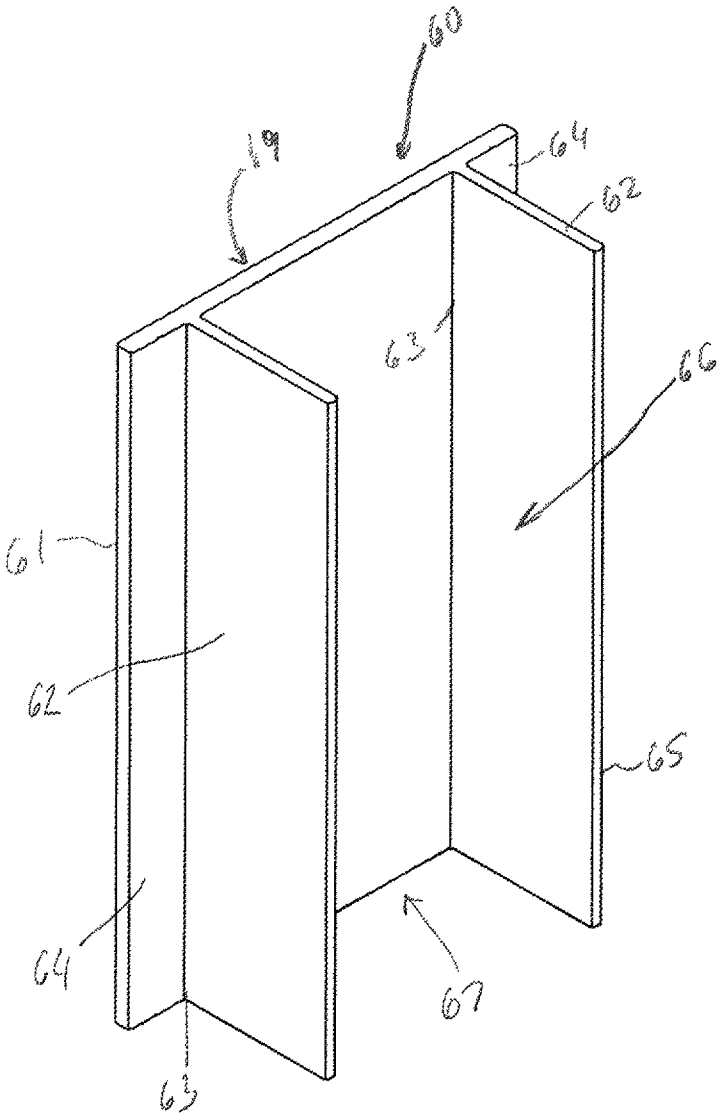
FIGS. 11 and 12 are a detailed diagram of the double tee bracket.
Figure 12:
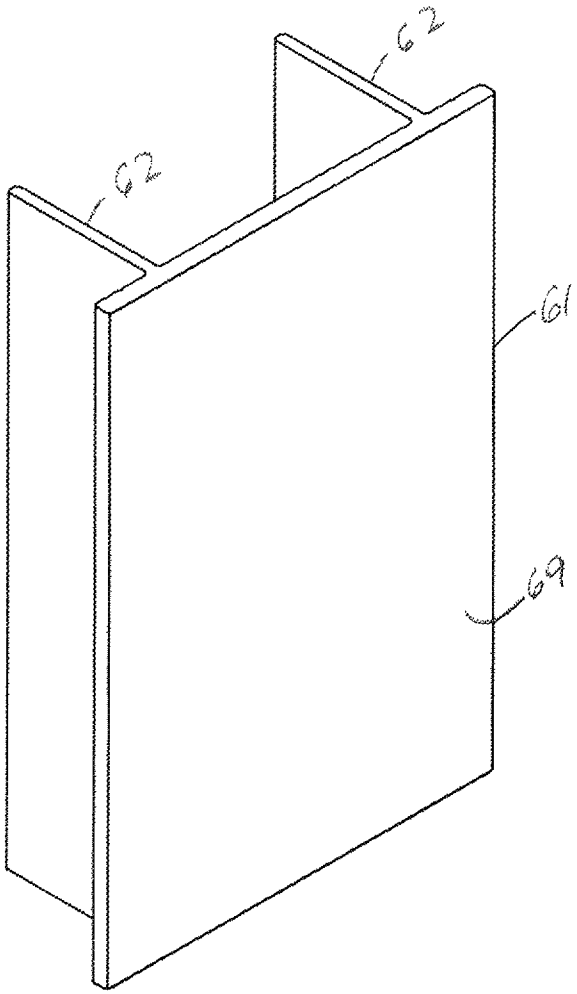

FIGS. 11 and 12 demonstrate the front and back of the double tee bracket 60. Shown are the forwardly extending walls 62 that are parallel and spaced apart from each other, defining a channel 66 for mounting distal ends of adjoining base tracks 20 therein. Shoulder sections 64 extend laterally on each side of the channel 66, with the shoulders 64 and the exterior surface 67 forming a base wall 61, where the back surface 69 is attached to an existing wall or a slab.

Figure 13:
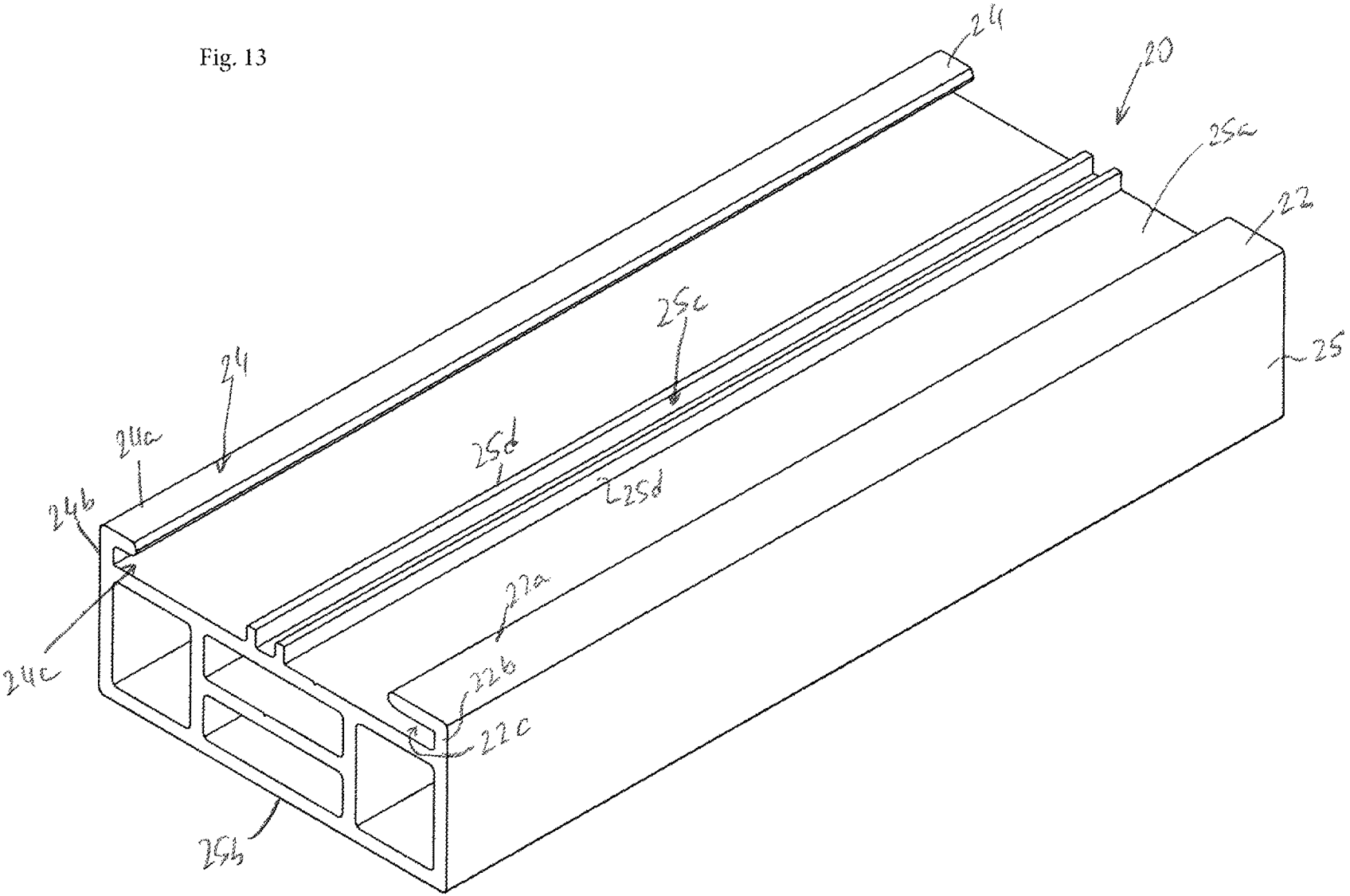
FIG. 13 is a perspective closeup view of the base support member.

FIG. 13 demonstrates the support track 20. The support track is formed from a top surface 25*a*, a bottom surface 25*b* and sidewalls 25. A first L-wall 22 and a second L-wall 24 extend over either long edge of the top surface 25*a* creating channels 22*c* and 24*c* respectively. A channel 25*c* running along the top surface 25*a* is intended to provide thread locking surface for fasteners with upright ribs 25*d*. Alternatively, the support track 20 may be comprised of only the top surface 24 and the first and second L-walls 22 and 24, respectively, with the channel 25*c* providing the required thread locking thickness necessary to retain a threaded shaft of a fastener mounting a slidable support member 80 to the top surface 25*a*. While one continuous channel 25*c* is shown, there may be multiple parallel or channels or channel sections.

FIG. 14 demonstrates the slidable support member 80, which is comprised from an inverted-U plate 84 and parallel upright walls 82. The upright walls 82 are oriented on one side and in the same line as direction of linear slide of the slidable support member 80. Alternatively, the parallel upright walls 82 may be placed more towards the middle of the plate 84 or to the opposite side thereof. Furthermore, in some configuration it is necessary for the parallel upright wall 82 to be pointed perpendicular to the linear motion of the slidable support member 80. The parallel upright walls 82 are comprised of the first wall 82*a* and the second wall 82*b*, forming a slot 85 therebetween for capturing the upright elongated panel 42. Either or both of the first and second walls 82*a* and 82*b*, respectively, may contain an upper rib 83 with an outwardly facing lip 82*c* facilitating the entry of the upright elongated plate 42 into the slot 85. Emerging from the two free edges of the inverted U-shaped plate 84 are wing walls 86*b* and 86*c* that ride within spaces 22*c* and 24*a* of the support track 20. Beveled walls 86*a* and 86*b* cause the wing walls 86*b* and 86*c* to on a co-axial but downwardly setoff plane with the top surface 86, thus creating a recessed bottom surface 87, which preferably rides just above the channel 25*c*. The fastener openings 86*f*, if defined, provide initial fastening means of the slidable support member 80 to a support track 20, with the slot 86*e* defining a fine lateral adjustment. Slots 82*e* define the initial fastening of the upright elongated plate 42, with slots 82*d* a providing a finer linear adjustment. Appreciably, slots that are perpendicular to the axis of the slots 82*d* may be provided to finely adjust the up and down orientation of the elongated upright panel.

Figure 15:
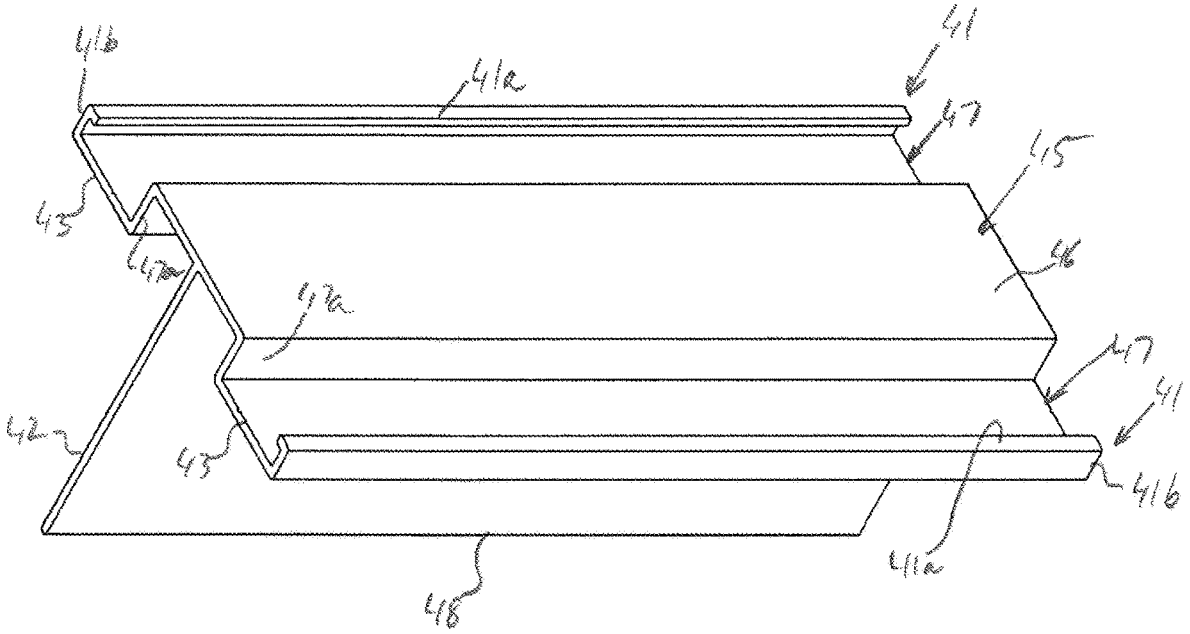
FIG. 15 is a perspective view of the adjustment support member.
Figure 16:
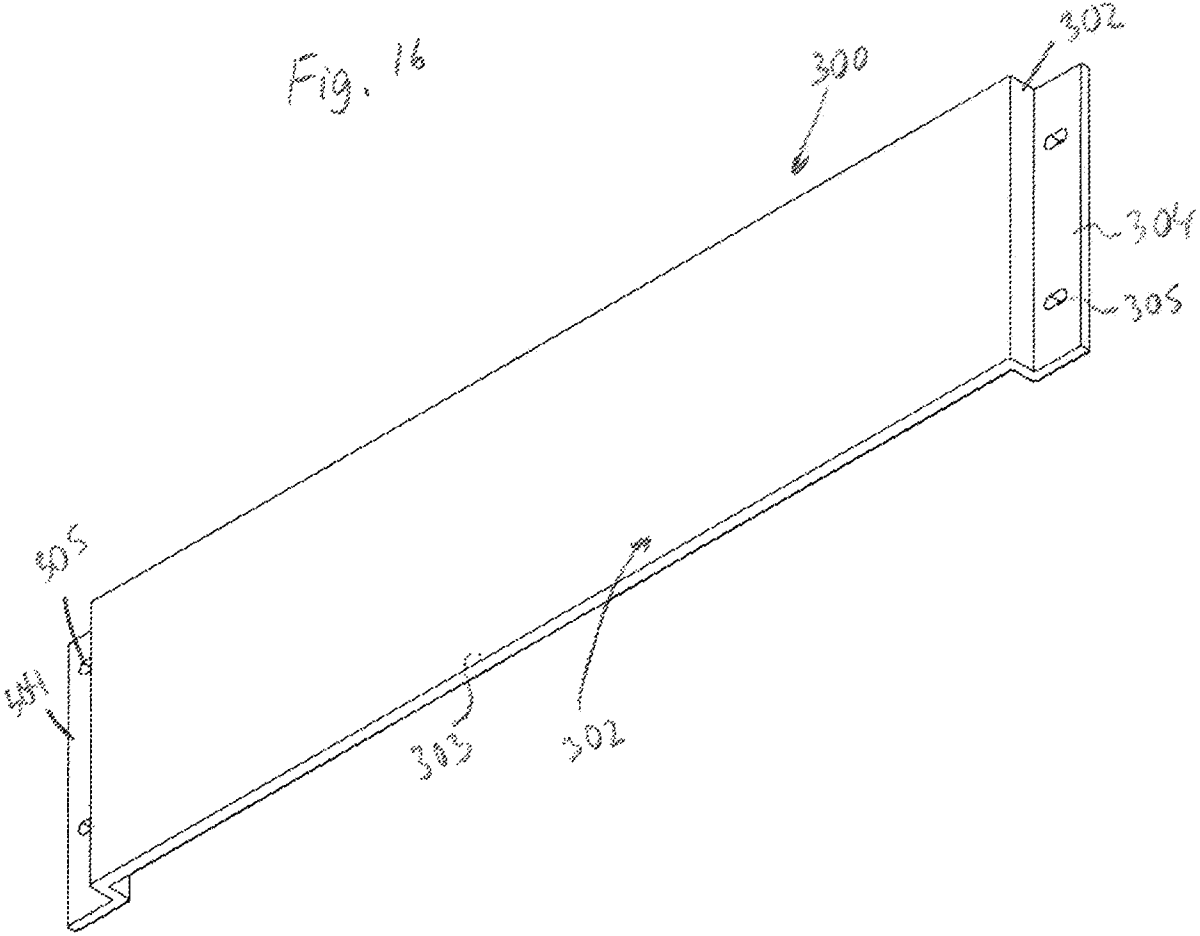
FIG. 16 is a perspective view of a support crossmember.

FIG. 15 demonstrates the adjustable support member 40. Having an upright elongated plate 42. A top wall 46 is centrally located above one edge of the upright elongated plate 42. Two U-shaped channels 47 are disposed to at least one side of the top wall 46. Each U-shaped channel 47 defined by a downward wall 47*a* extending downward from the edge of a top wall 46. A wall 43 extends outwardly at an angle, preferably a right angel from the free edge of each downward wall 47*a*. With an L-wall 41 extending upward from the free edge of each wall 43. The L-walls 41 comprising of upward portion 41*b* and inward bending lip 41*a*. Alternatively, bilge FIG. 16 presents a crossmember 300, having an elongated plate 303, having an outer surface 302. Wingwalls 304 issue on each narrow edge of the elongated plate 303, with the backward extending wall 302 causing the wingwalls to be in a co-axial but rearwardly offset orientation with the elongated plate 303. Fastener openings 305 case the crossmember 302 to be attached to a U-shaped channel 47 of a support assembly 12.

Figure 17:
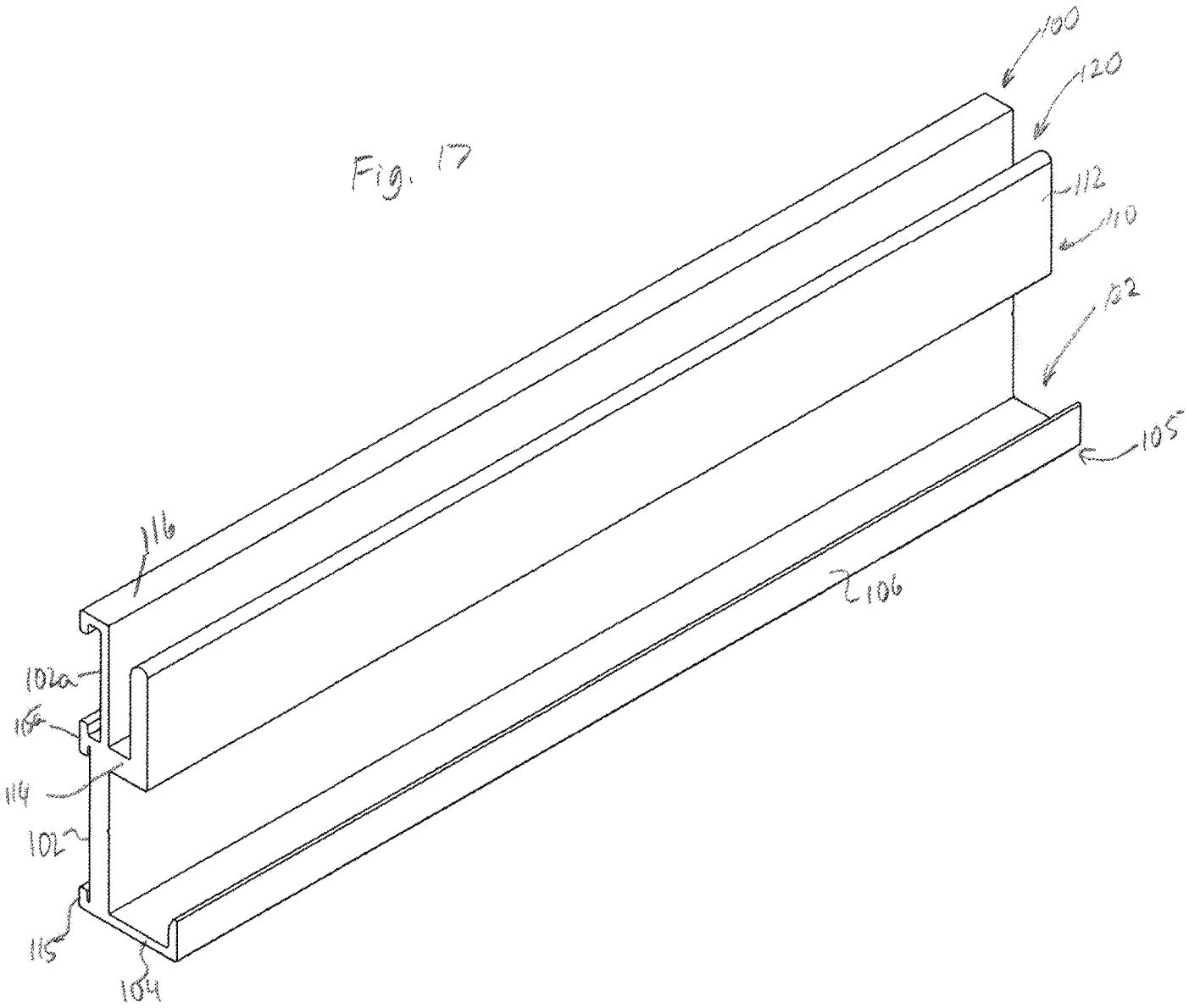
FIG. 17 is a perspective view of a double-L support crossmember.

FIG. 17 demonstrates the double-L crossmember 100, with the first L-wall 105 forming a first channel 122 and a second L-wall forming a second channel 120. Note that the backwall 102 may be uniform in thickness or contain a thinner portion 102*a* between the third wall 114 and the fifth wall 116.

Figure 18:
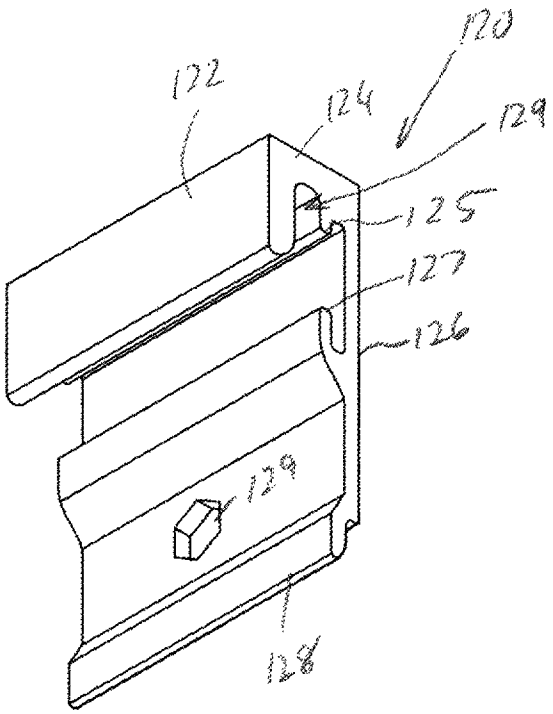
FIG. 18 is a closeup perspective view of an R-bracket.

A detailed representation of an R-bracket 120 is shown in FIG. 18, comprising of a first wall 126, a second wall 124 and a third wall 122. A channel 129 mounts over the fifth wall 116, with the protruding wall 127 facing upward. The protruding wall 127 is intended to grab the third wall 114 from below once the second wall 124 is mounted over the fifth wall 116 of the double-L crossmember 100. A fastener opening 129 mounts the R-bracket 120 onto back of a wall panel 400, with the fifth wall 128 extending downwards in a co-axial forwardly setoff orientation with the back wall 126. The fifth wall 128 is configured to be interlocking with the upwardly extending second wall 106 of the first channel L-wall 105.

Figure 19:
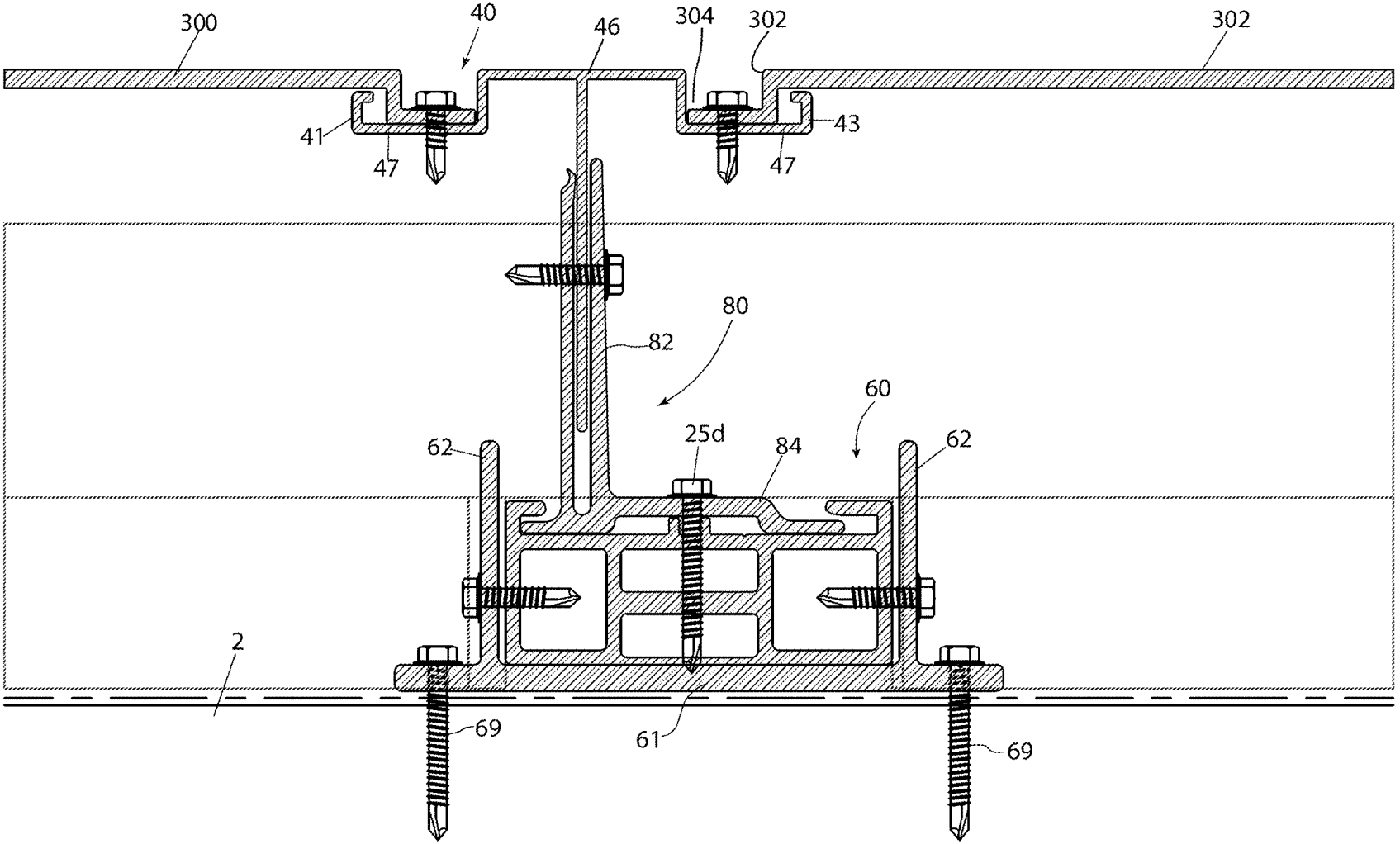
FIG. 19 is a cross sectional view of the assembly system shown in FIG. 2.

FIG. 19 provides the cross-sectional assembly shown in FIG. 2. The double tee bracket 60 is mounted onto a slab 2 or unto an exterior surface of a wall. A support track 20 is mounted within the double tee bracket 60, with the sliding support member 80 slidingly disposed on top of the support track 20. An elongated upright plate 42 is retained in the gap 85 of the sliding support member 80. The adjustable support member 40 contains U-shaped channels 47 that are used as mounting points for rearwardly offset wingwalls 304 of crossmembers 300.

Figure 20:
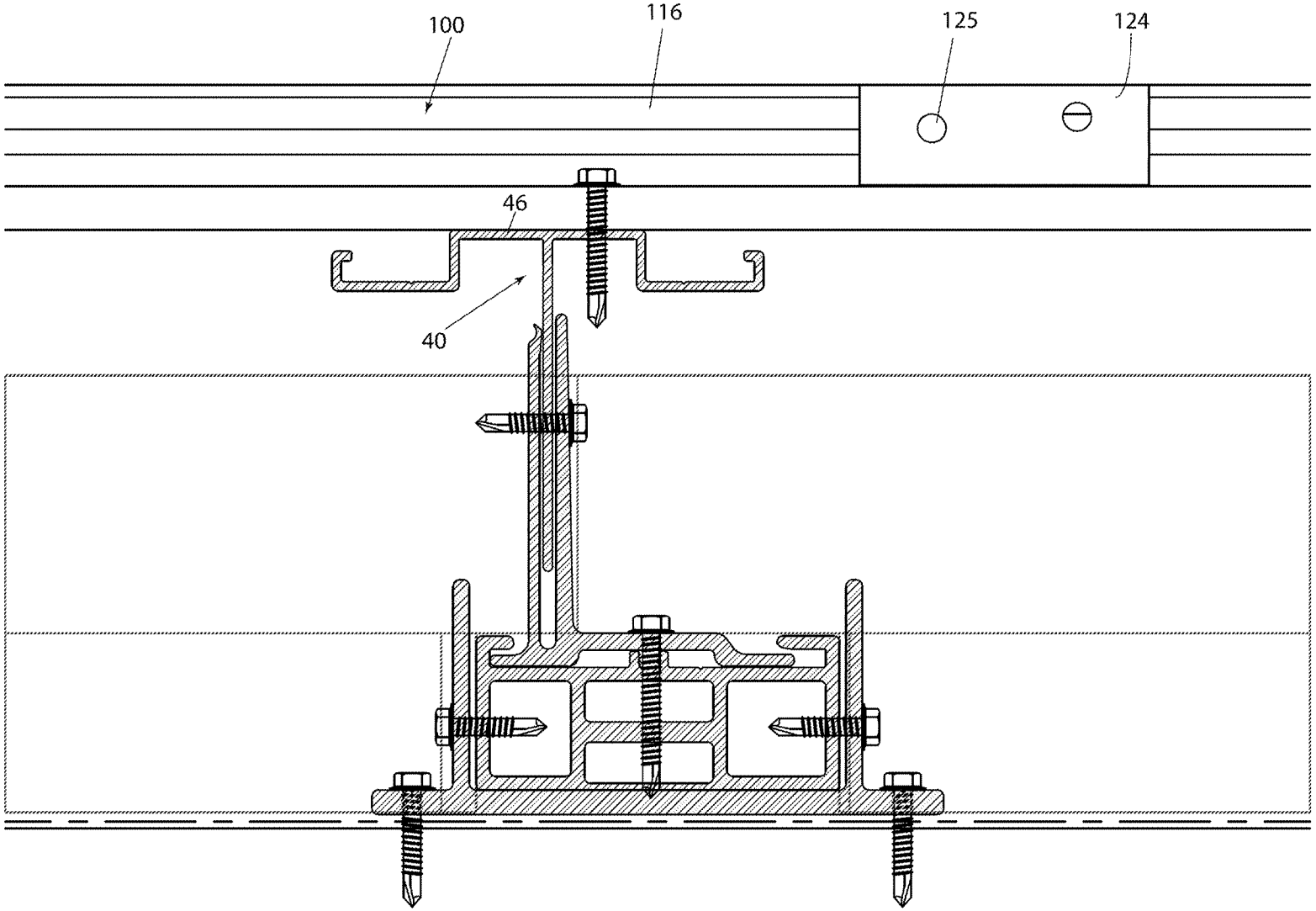
FIG. 20 is a cross sectional view of the assembly system shown in FIG. 1.
Figure 21:
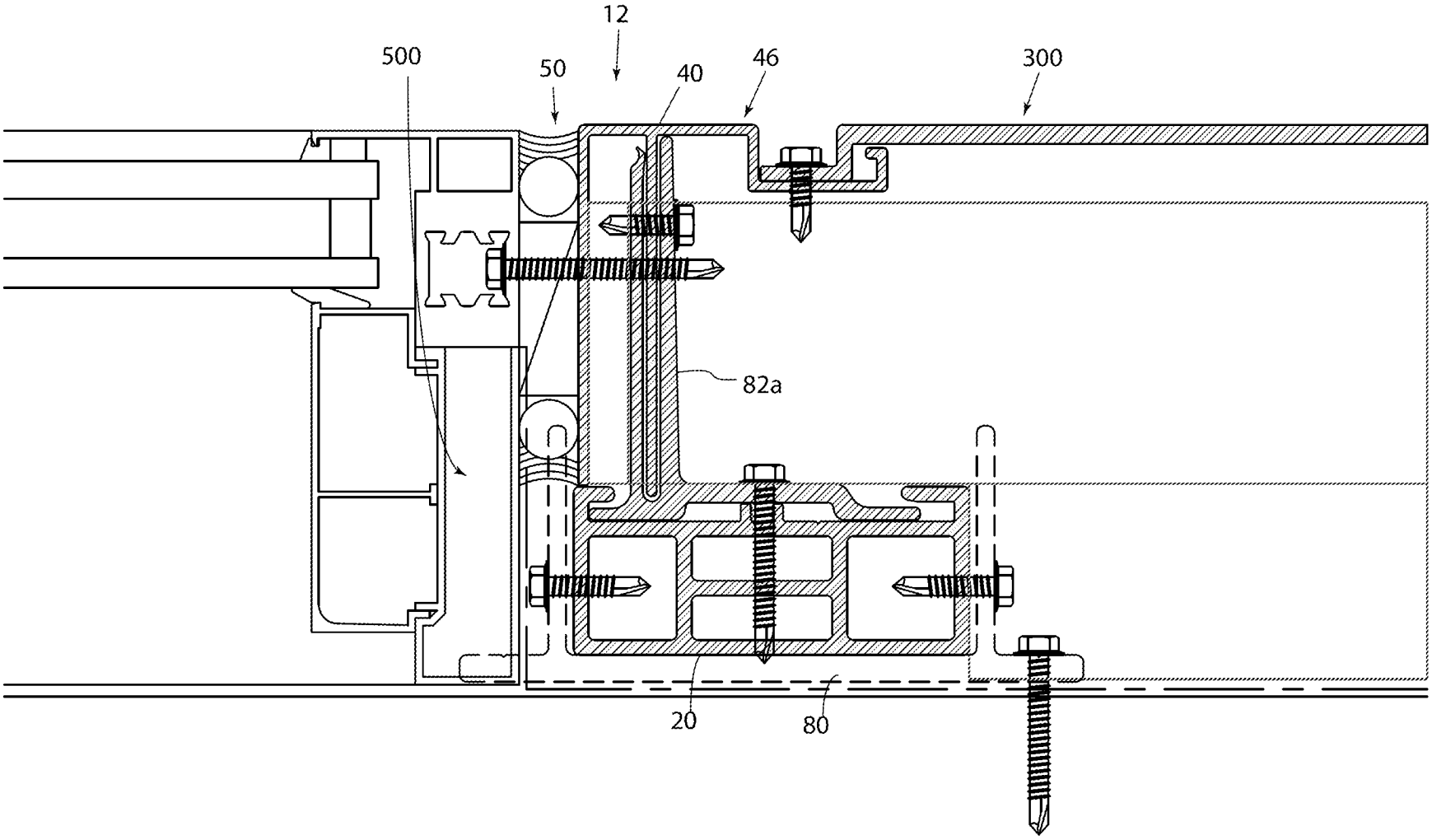
FIG. 21 is a cross sectional view of the assembly system shown in FIG. 1, demonstrating the window portion of the assembly.
Figure 22:
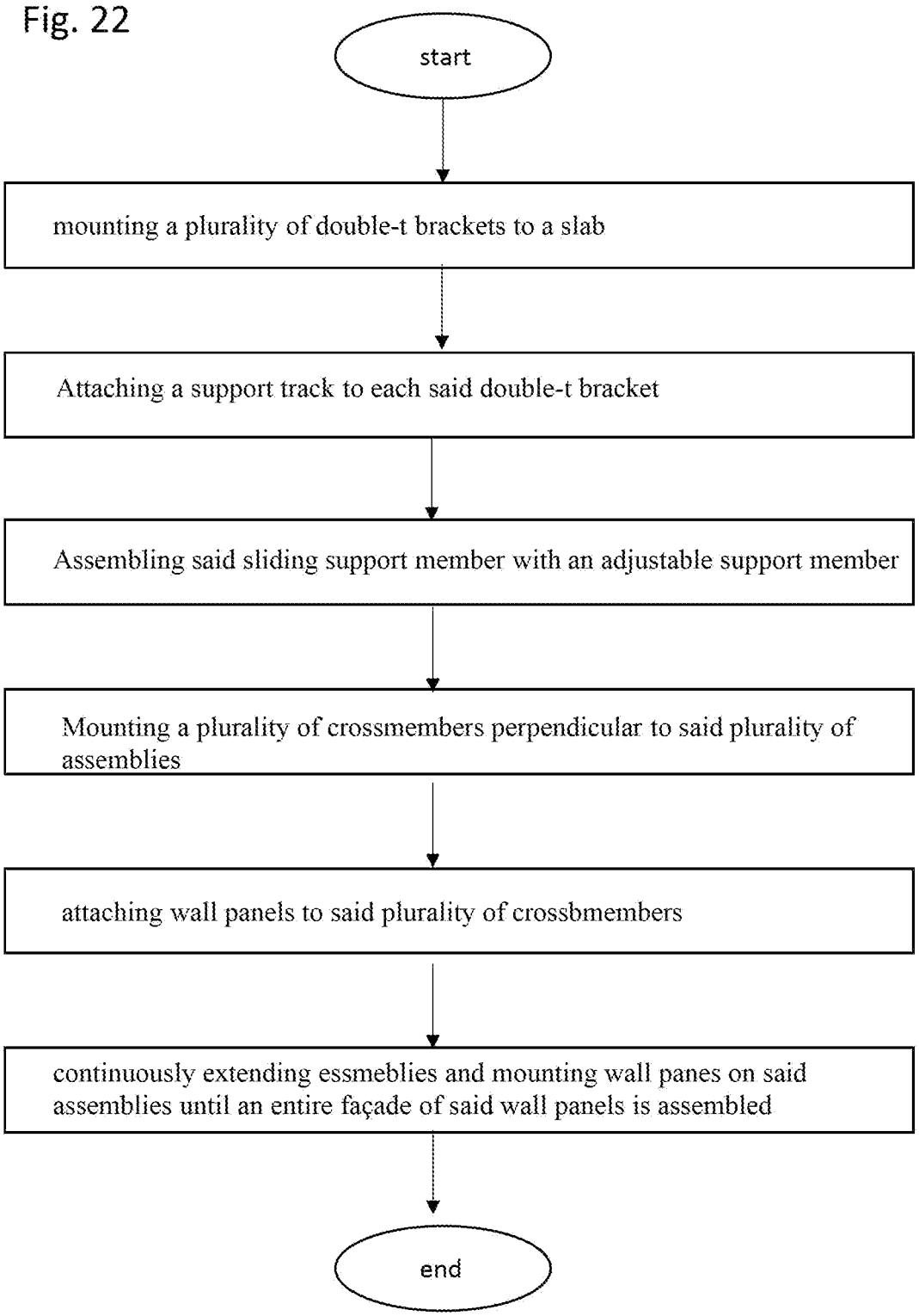
FIG. 22 is a diagram of a method of assembling of a business façade utilizing the disclosed system.

FIG. 20 demonstrates a top view of components shown in FIG. 19, but demonstrating the attachment of the double-L crossmember 100 attached to the fifth wall 116 with fastener openings 125. FIG. 21, demonstrates a window attachment of an adjustable support member 40. A backwardly extending wall 50 extends from the free edge of the top wall 46 that is next to the window frame. The backwardly extending wall 50 then becomes parallel with the window frame and may accept fasteners from or drive fasteners into the frame 500 from the assembly 12.

The disclosed invention also teaches a method of attaching panels to floor slabs comprising

- The steps of mounting a plurality of upright parallel assemblies onto exposed floor slabs such that assemblies run from slab on one floor to slab on an adjacent floor;
- Mounting wall panels unto said plurality of upright parallel assemblies; Wherein the step of mounting a plurality of upright parallel assemblies, further comprises mounting a plurality of double-t brackets to a slab, said double-t brackets being in a parallel and spaced apart orientation to each other
- Attaching a support track to said double-t bracket, said support track running from a double-t bracket on one floor to a double-t bracket on an adjacent floor;
- Mounting an assembly of a sliding support member having an adjustable support member mounted therein;
- Mounting a plurality of crossmembers perpendicular to said plurality of assemblies; and attaching wall panels to said plurality of cross members.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A system for attaching panels to an existing floor slab comprising a plurality of parallel support assemblies, wherein each parallel support assembly within said plurality of parallel support assemblies is comprised of at least two double tee brackets mounted onto an exposed surface of a first floor slab and wherein a second of said at least two double tee brackets mounting on a floor slab of a floor above or a floor below from said first floor slab, wherein said at least two double tee brackets are mounted on the same axis; at least one segment of support track, said at least one segment of support track mounting within said at least two double-tee brackets; wherein a length of said support track is defined by a distance between said first floor slab and said second floor slab; at least one sliding support member, said at least one sliding support member being slidingly received within said support track; an adjustable support member removingly assembled with said at least one sliding support member, a plurality of crossmembers removably disposed across at least two of said plurality of support assemblies; and wherein each said parallel support assembly configured to be disposed vertically across all floors of a structure.

2. The system of claim 1, wherein each of said at least two double tee brackets is comprised of a base wall and at least one forwardly extending wall, said at least one forwardly extending wall being at an angle to said base wall, wherein said at least one forwardly extending wall configured to be detachingly assembled with said support track.

3. The system of claim 2, wherein said support track is comprised of a top surface and a bottom surface; wherein two L-walls are disposed along edges of said top surface; each of said two L-walls creating a space between said top surface and said L-wall.

4. The system of claim 3, wherein said top surface further comprising a channel said channel having two parallel ribs that are configured to retain a shaft of a fastener.

5. The system of claim 4, wherein said sliding support member is further comprised of an inverted U-shaped wall supporting two parallel walls extending upwardly therefrom; two wingwall extending laterally from free ends of said inverted U-shaped wall; said two wingwalls slidingly received within said spaces of said L-walls; and wherein said two parallel walls having a gap therebetween.

6. The system of claim 5, wherein said sliding support member is made of thermally insulating materials.

7. The system of claim 6, wherein the adjustment support member further comprises an elongated upright panel, a top wall centrally disposed along an edge of said elongated upright panel, wherein said elongated upright panel removingly retained within said gap.

8. The system of claim 7, wherein each of said plurality of crossmembers is a double-L crossmember having a first L-wall and a second L-wall arranged in a stacked orientation with each other; and a top wall being above said second L-wall.

9. The system of claim 8, further comprising an R-bracket, said R-bracket having a first wall, a second wall forwardly extending from a top edge of said first wall, a third wall downwardly extending from said second wall, said third wall being in parallel and spaced configuration with said first wall; and wherein said third wall being shorter than said first wall; a fourth wall extending from a bottom edge of said first wall in a downward and offset orientation with said first wall; wherein said second wall is fasteningly mounted on said top wall of said double-L crossmember and wherein said fifth wall interconnects with said first L-wall.

10. A system for attaching panels to an existing floor slab comprising a plurality of parallel support assemblies, wherein each parallel support assembly within said plurality of parallel support assemblies is comprised of at least two double tee brackets mounted onto an exposed surface of a first floor slab and wherein a second of said at least two double tee brackets mounting on a floor slab of a floor above or a floor below from said first floor slab, wherein said at least two double tee brackets are mounted on the same axis; at least one segment of support track, said at least one segment of support track mounting within said at least two double-tee brackets; wherein a length of said support track is defined by a distance between said first floor slab and said second floor slab; at least one sliding support member, said at least one sliding support member being slidingly received within said support track; an adjustable support member removingly assembled with said at least one sliding support member; a plurality of crossmembers removably disposed across at least two of said plurality of support assemblies; and wherein each said parallel support assembly configured to be disposed vertically across all floors of a structure.

11. The system of claim 10, wherein each of said at least two double tee brackets is comprised of a base wall and at least one forwardly extending wall, said at least one forwardly extending wall being at an angle to said base wall, wherein said at least one forwardly extending wall configured to be detachingly assembled with said support track.

12. The system of claim 11, wherein said support track is comprised of a top surface and a bottom surface; wherein two L-walls are disposed along edges of said top surface; each of said two L-walls creating a space between said top surface and said L-wall.

13. The system of claim 12, wherein said sliding support member is further comprised of an inverted U-shaped wall supporting two parallel walls extending upwardly therefrom; two wingwall extending laterally from free ends of said inverted U-shaped wall; said two wingwalls slidingly received within said spaces of said L-walls; and wherein said two parallel walls having a gap therebetween.

14. The system of claim 13, wherein said sliding support member is made of thermally insulating materials.

15. The system of claim 14, wherein the adjustment support member further comprises an elongated upright panel, a top wall centrally disposed along an edge of said elongated upright panel, wherein said elongated upright panel removingly retained within said gap; at least one U-shaped channel running along a long edge of said top wall.

16. The system of claim 15, wherein each of said plurality of crossmembers is comprised of an elongated panel having wingwalls extending coaxially with said elongated panel in a rearward offset configuration with said elongated panel; wherein each of said wingwalls fasteningly attached within said U-shaped channel of one support assembly and wherein opposing one of said wingwalls is fasteningly attached within said U-shaped channel of an adjacent of support assembly of said plurality of support assemblies.

17. The system of claim 13, wherein said top surface further comprising a channel said channel having two parallel ribs that are configured to retain a shaft of a fastener.

18. A method of attaching panels to floor slabs comprising:

mounting a plurality of upright parallel assemblies onto exposed floor slabs such that assemblies are configured to line a slab of one floor to a slab on an adjacent floor;

mounting wall panels onto said plurality of upright parallel assemblies;

wherein the step of mounting a plurality of upright parallel assemblies further comprises:

mounting a plurality of double-t brackets to a slab, said double-t brackets being in a parallel and spaced apart orientation to each other;

attaching a support track to each of said double-t brackets, said support track running from one of said double-t brackets on said slab which comprises one floor to a double-t bracket on an adjacent floor;

assembling said sliding support member with an adjustable support member;

mounting a plurality of crossmembers perpendicular to said plurality of assemblies;

and attaching wall panels to said plurality of crossmembers.

19. The method of claim 18, further comprising a step of continuously extending said assemblies and mounting said wall panels on said assemblies until an entire façade of said wall panels is assembled.

* * * * *